US009076332B2

(12) United States Patent
Myr

(10) Patent No.: US 9,076,332 B2
(45) Date of Patent: Jul. 7, 2015

(54) MULTI-OBJECTIVE OPTIMIZATION FOR REAL TIME TRAFFIC LIGHT CONTROL AND NAVIGATION SYSTEMS FOR URBAN SATURATED NETWORKS

(75) Inventor: David Myr, Jerusalem (IL)

(73) Assignee: Makor Issues and Rights Ltd., Jerusalem (IL)

( * ) Notice: Subject to any disclaimer, the term of this patent is extended or adjusted under 35 U.S.C. 154(b) by 981 days.

(21) Appl. No.: 11/583,333

(22) Filed: Oct. 19, 2006

(65) Prior Publication Data

US 2008/0094250 A1 Apr. 24, 2008

(51) Int. Cl.

| | |
|---|---|
| ***G08G 1/08*** | (2006.01) |
| ***G08G 1/04*** | (2006.01) |
| ***G08G 1/081*** | (2006.01) |
| *G08G 1/0968* | (2006.01) |

(52) U.S. Cl.

CPC ..... *G08G 1/04* (2013.01); *G08G 1/081* (2013.01); *G08G 1/096811* (2013.01)

(58) Field of Classification Search

CPC ... G08G 1/04; G08G 1/081; G08G 1/096811; G08G 1/085; G08G 1/083; G08G 1/082; G08G 1/07; G08G 1/095

USPC ..... 340/901, 907, 909, 910, 942; 701/117, 701/202, 1, 116, 118; 702/181; 706/16–21; 370/437

See application file for complete search history.

(56) References Cited

U.S. PATENT DOCUMENTS

| | | | | |
|---|---|---|---|---|
| 4,258,351 | A * | 3/1981 | Shigeta et al. | 340/942 |
| 5,572,449 | A * | 11/1996 | Tang et al. | 700/304 |
| 6,075,874 | A * | 6/2000 | Higashikubo et al. | 382/104 |
| 6,317,058 | B1 * | 11/2001 | Lemelson et al. | 340/910 |
| 6,577,946 | B2 * | 6/2003 | Myr | 701/117 |
| 6,587,778 | B2 * | 7/2003 | Stallard et al. | 701/117 |
| 6,633,238 | B2 * | 10/2003 | Lemelson et al. | 340/909 |
| 6,662,141 | B2 * | 12/2003 | Kaub | 702/181 |
| 6,704,645 | B1 * | 3/2004 | Beesley et al. | 701/202 |
| 6,882,930 | B2 * | 4/2005 | Trayford et al. | 701/117 |
| 2002/0165837 | A1 * | 11/2002 | Zhang et al. | 706/16 |
| 2005/0134478 | A1 * | 6/2005 | Mese et al. | 340/901 |
| 2005/0140523 | A1 * | 6/2005 | Publicover | 340/907 |
| 2006/0125655 | A1 * | 6/2006 | McMahon | 340/907 |

* cited by examiner

*Primary Examiner* — Steven Lim
*Assistant Examiner* — Sisay Yacob
(74) *Attorney, Agent, or Firm* — Caesar Rivise, PC

(57) ABSTRACT

A multiobjective management system for saturated traffic road networks comprising: green wave coordination of locally adaptive traffic control units, traffic movement optimization and live traffic route guidance. Current traffic congestion measurements on intersections are generated from local traffic cameras and remote air-borne conventional cameras and thermal sensing imaging cameras or satellite radar such as SAR/ISAR using optical image brightness analysis. At the first stage of traffic optimization, individual local intersection green times are computed based on current traffic congestion level. At the second stage optimization, the central traffic server uses a multiobjective approach to coordinate the current locally-optimized green times of the first stage and create input constraints for green-way coordination of plurality of traffic lights. The server updates dynamically current cycle start and green times on all network-connected traffic light controllers and also broadcasts recommended travel times, green times and green waves to all on-line client vehicle navigation units. Traffic server and individual client guidance units utilize novel time-dependent modifications of an A*-type algorithm to update current travel and recommended travel times and to execute fastest route searches.

6 Claims, 14 Drawing Sheets

NETWORK TRAFFIC CONTROL CONFIGURATION

Fig. 2 LOCAL CONTROLLER AND CENTRAL SERVER

Fig. 3b VIDEO IMAGE OF 3D-TL LAYOUT
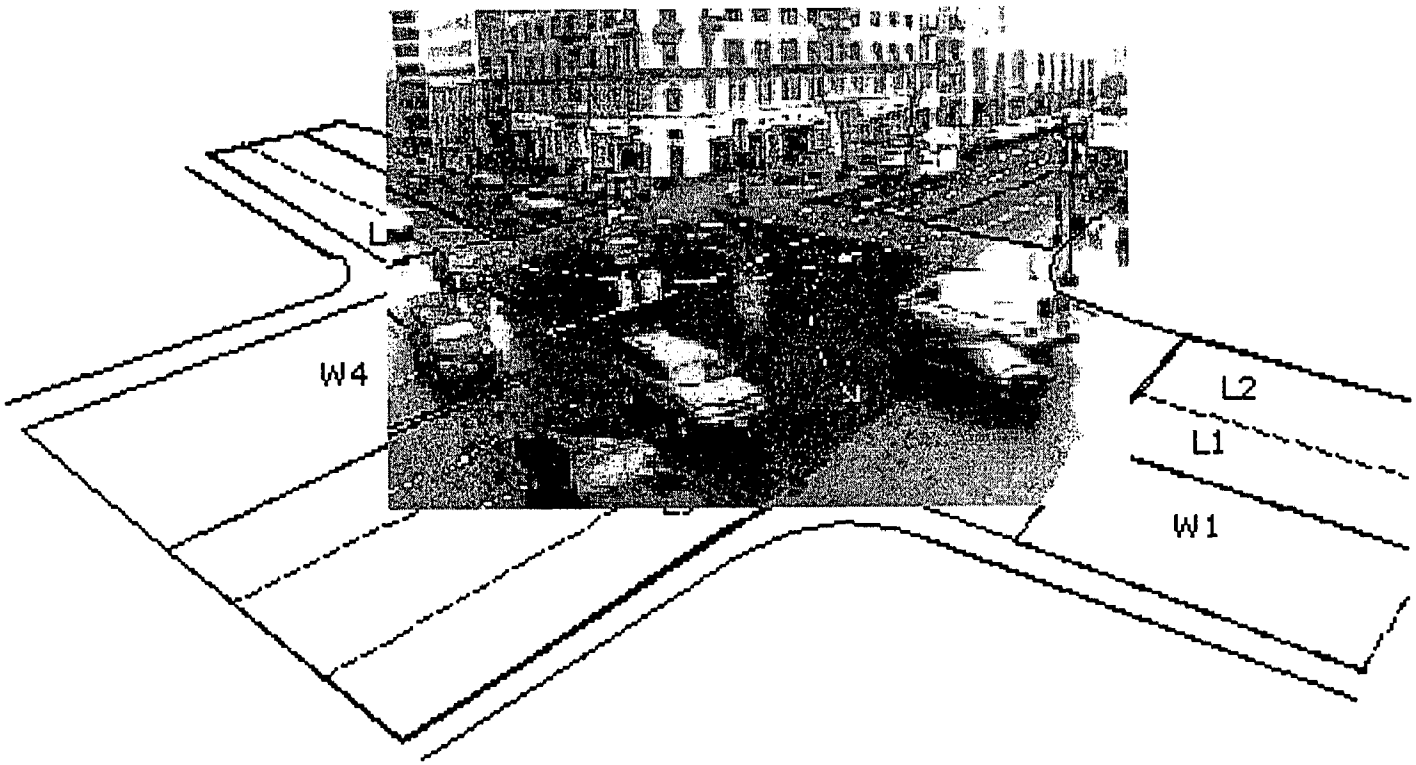

Fig. 5 GUI

1st STAGE OPTIMIZATION-USER INPUT

1st and 2nd STAGE OPTIMIZATION

Navigation Information Flow

Map Cells and Cell Distances

Reference Points and Precalculated Routes

SHORT TRAVEL TIME PREDICTION FUNCTION

SHORT TERM PREDICTION FUNCTION WITH FASTEST ROUTE SEARCH

MULTI-OBJECTIVE OPTIMIZATION FOR REAL TIME TRAFFIC LIGHT CONTROL AND NAVIGATION SYSTEMS FOR URBAN SATURATED NETWORKS

PRIOR ART

Dense traffic, heavy congestion and saturated intersections are unfortunately well known phenomenon in our daily lives, Vehicle jams in urban areas and slow-moving traffic may have many causes and do not always signify traffic control failures but inadequate traffic control strategies often contribute to traffic slow-downs.

It appears at present, that at certain saturation levels no single traffic control system or timing plan whether fixed or regulated can continue to function or prevent "traffic failures" and rather than regulating traffic often even add to "jam" conditions.

Despite massive investment in traffic control equipment, expertise and manpower, what is lacking is a dynamic and traffic-adaptive light control system capable of responding to real-life saturated traffic scenarios. Efficient comprehensive traffic management requires flexible and adaptive means of real time traffic control on a local level and provide wide live-traffic coordination for traffic dispersion on network scale. Additionally, there is a real need to provide early traffic warning information to drivers before they enter the congested areas.

Due to complexities involved in network traffic control, prior art analysis is divided into three main categories: a) traffic control systems b) traffic data collection and surveillance systems c) traffic navigation and advisory systems.

a) Traffic control—Centralized vs. Adaptive Systems:

Conventional traffic systems utilize various levels of sophistication of management methods ranging from fixed-timed to centrally coordinated and adaptive light control. These systems are generally based on centralized traffic data collection using roadside traffic-density and movement monitors and statistical traffic data. Advanced Traffic Management Systems ATMS also use various additional learning methods to adapt phases of traffic lights and attempt to "dynamically modify signal timings in response to changing traffic demand and to coordinate operation with adjacent signals to maximize the roadway (network) throughput." [DOT, 1996]

Programs such as TRANSYT are used by hundreds of consultancies and local authorities applying off-line computer programs in determining optimum fixed-time coordinated traffic light timings for complex road networks where the average traffic flows are known. TRANSYT program calculates traffic Performance Index (PI) in monetary terms, whilst an optimizing routine searches for sequences which reduce the PI to a minimum value—subject to minimum green and other constraints.

SCOOT (Split Cycle Offset Optimization Technique) is another example of an adaptive program which can respond automatically to traffic fluctuations. It does away with the need for light plans that are expensive to prepare and keep up to date. SCOOT has also been used extensively around the world relying on real time traffic data from existing road loop detectors.

Examples of stage-based strategies are SIGSET and SIGCAP Stage-based strategies under this class determine the optimal splits and cycle time to minimize the total delay or maximize the said intersection capacity. Centralized systems generally perform well in under-saturated traffic but can severely under-perform in congested networks. Due to centralization these systems may also have many technical difficulties—large number of sensors that are required, traffic density data needs to be centrally processed resulting in relatively high output delay (10-50 minutes) which is often most critical factor in dense traffic. Traffic updates if available, requires frequent broadcasts resulting in extensive communication network and generalized traffic packet data are used rather than specific data outputs suitable for client interface. Often the traffic control and traffic navigation systems are operated by two totally different and segregated structures making dynamical coordination between the two more difficult.

Adaptive Systems:

Adaptive and self-organizing systems aim to avoid the centralized costs and delay inefficiencies in the prior art. However these systems appear to be more successful in managing under-saturated traffic with less or no attention to saturated urban networks. Due to the decentralized nature of these systems they also do not deal with network traffic dispersion or travel guidance.

Lemelson et al. U.S. Pat. No. 6,633,238 shows a method for control traffic lights by selectively distributing warning messages to motorists and uses fuzzy logic to determine optimum traffic light phase-split with GPS.

Stallard et al. U.S. Pat. No. 6,587,778 relates a rule-based method for adaptive signal control of traffic networks where the signal control logic consists of a set of rules for uncongested control and fixed time plan for congested control.

Nishihara et al. JP2001093082 presents an offset deciding mechanism for unexpected traffic fluctuations for real time smoothing.

Other theoretical adaptive models such as Marco Wiering, et al marco@cs.uu.nl and C. Gershenson http://homepages-.vub.ac.be/~cgershen deal with self-organizing traffic lights that aim to provide optimal control for local traffic lights but do not deal effectively with alleviating traffic delays in the saturated networks. Drivers will be trapped in high congested areas without any real exit options. The traffic warnings on incidents and high density congestion are inadequate once the vehicles enter saturated zones to be really useful.

b) Traffic data collection—real time traffic video systems:

Traffic optimization and adaptive systems all require real time traffic data collection input as a basis for their computations. Whether they are road imbedded or electronic sensors these typically represent a large part of the traffic control budgets. Use of video cameras in congestion metering is generally more cost effective and well known. Many sophisticated traffic data collection systems have been proposed for vehicle recognition, tracking and congestion with good results. Systems such as Autoscope use VVDS video vehicle detection system using detection algorithm for many traffic applications for vehicle surveillance. See Autoscope (www.econolite.com).

Porikli et al US 2005/0190975 use video cameras to extract congestion features using Gaussian Mixture Hidden Markov Models (GM-HMM);

Maurin, Masoud, Papanikolopoulos; propose real-time image processing of crowded outdoor scenes by tracking object movements etc.

Masakatsu et al. U.S. Pat. No. 6,075,874 measures traffic congestion by utilizing a video camera to capture images of vehicles traveling on a road and analyzing sample points that are assigned to different aspects of the images. Presence and movement sample points correspond to the expected location and motion of the vehicles respectively. The state of traffic congestion is measured based upon the resultant movement and congestion blocks.

Glier et al. US 2002/0054210 uses predetermined sets of pixels ("tiles") to study shape and motions of group of active tiles and analyze them with software and a neural network to detect and track vehicles. The disclosed system is employed as a traffic light violation prediction system for a traffic signal, and as a collision avoidance system. A video camera is employed to obtain a video image of a section of a roadway. Motion is detected through changes in luminance and edges in frames of the video image. Predetermined sets of pixels ("tiles") in the frames are designated to be in either an "active" state or an "inactive" state. A tile becomes active when the luminance or edge values of the pixels of the tile differ from the respective luminance or edge values of a corresponding tile in a reference frame in accordance with predetermined criteria. Shape and motion of groups of active tiles ("quanta") are analyzed with software and a neural network to detect and track vehicles.

Anders et al. U.S. Pat. No. 6,489,920 uses bodies above the surface of the earth such as SAR radar to overcome cost of individual video cameras and provide vehicle densities to obtain state of street traffic.

While the real time traffic-video data collection systems are less costly than imbedded traffic reporting systems, large number of traffic cameras is still required for large scale coverage urban networks. In the present invention digital traffic images are used as a main source of traffic data input with the emphasis on a fast and inexpensive local solution. The processing can be immediately outputted to local light controller for a best live response. In another embodiment we propose the use of more advanced methods such as synthetic aperture radar (SAR) systems, best utilized in real time so that the radar-based images can provide continuous area coverage for a given urban area and can be processed immediately to record and detect vehicles on 24-hour basis.

c) Traffic Navigation and Advisory Systems:

Publicover et al. US 2005/0140523 uses a traffic control device to transmit information to approaching vehicles regarding its current and future state enabling vehicles to control their speed to avoid arriving at the traffic control device TCD until it permits the passage of traffic, thus avoiding stopping, idling and reaccelerating when reaching the traffic control device. While this system computes the maximum speed below the speed limit by dividing the distance to the intersection by the time remaining until the TCD turns green it has no optimization means to compute optimal recommended speed based on the vehicle's current speed nor does it compute the current traffic status on other approaches of the traffic light.

Trayford et al. (U.S. Pat. No. 6,882,930) describes a system capable of providing traffic or related information to drivers in real time and also capable of integrating historical, real time and associated traffic data with respect to traveler profiles to produce customized forecasted traffic information. However, it does not describe how all this information could be efficiently used in route searching algorithms of the A*-type with the purpose of providing precise driving instructions. In particular, it mentions only Dijkstra-type algorithms that are not suitable for utilizing this sort of information.

Lemelson et al. (U.S. Pat. No. 6,317,058) describe a system and method for controlling traffic and traffic lights and selectively distributing warning messages to motorists. They use fuzzy logic methods for controlling traffic lights and providing real time, relevant traffic information to motorists based on their location and travel direction. The GPS coordinates of a motor vehicle are calculated in the vehicle, and the fuzzy logic calculation determining the degree of danger is made in the vehicle. Thereby the driver is made aware of situations to be avoided and the fuzzy logic calculated degree of danger or concern by audio announcement or visual message display. However, they do not suggest fuzzy logic or any other methods that could be efficiently used in route searching for providing precise driving instructions.

Lapidot, 2002 (U.S. Pat. No. 6,341,255) and its continuation in part Lapidot et al., 2002 (U.S. Pat. No. 6,490,519) describe a route guidance system for providing individualized route guidance to from at least one and up to each one of a plurality of selected individual vehicles in a traffic network. Route guidance is provided with each piece of intermediate location information relating to a different intermediate position of the selected vehicle that is between the selected vehicle's stating position and its destination position, each piece of intermediate location information being measured at a different known time, and such that pairs of pieces of location information are utilized to determine segments of a recommended route of travel for each vehicle. In route calculations, velocity characteristics and various traffic stream events are taken into consideration and used in the process of route determination. However, they do not provide clear means for incorporating all this information in route searching algorithms for the purpose of providing precise driving instructions.

Fan et al., 2003 (U.S. Pat. No. 6,594,576) describe a system and a method for determining and disseminating current traffic information. A traffic data compilation computer collects location data from mobile units, calculates the velocity of each mobile unit, compares this velocity against speed limit data stored in a memory, and determines the traffic condition based on the difference between the velocity of each mobile unit and the speed limit. In addition, traffic data compilation computer may determine the fastest route between point A and point B under the current traffic conditions. However, no means is provided for incorporating all this information in route searching algorithms for the purpose of providing precise driving instructions.

Kopetzky, 2003 (U.S. Pat. No. 6,529,736) describes a navigation configuration that utilizes a communications network, an access device, a processing system central to the communications network, a navigation database connected thereto, a location determining device, a route control system and an output device connected to the route control system. The output device outputs local navigation information for directing a travel direction of a user. However, no means is provided for incorporating all this information in route searching algorithms for the purpose of providing precise driving instructions. However, no detailed route searching algorithms utilizing topographical and time dependent information similar to those in the present invention are presented.

Nimura, 2005 (U.S. Pat. No. 6,937,936) provides a new navigation apparatus by which the map data stored on the storage medium may be updated through communication means with the latest-version map data. Thereby, the map data may be updated as needed, allowing the navigation apparatus to correctly search a route or retrieve a facility even in the case of a new road being opened, a new facility being constructed, or an existing facility being torn down. This may shorten the time for updating the map data as well as lowers the cost of map data update. Though useful in some circumstances, this invention does not provide real time dynamic facilities described in the present invention.

Schirmer et al., 2005 (US Application 2005/0171694) describe a navigation system and method having a function of alerting the driver to potential wrong way driving situations.

It comprises among other units a potential wrong way driving unit that detects the potential wrong way driving situation and generates an indication at the means for outputting associated with the potential wrong way driving situation. It is also capable of selecting a driving route from a plurality of driving routes stored on a storage medium of an external server. The system may have considerable advantages especially for inexperienced drivers but it does not preempt the present invention with its real time dynamic facilities for fastest route search.

Yoshikawa et al., 2005 (US Application 2005/0209772) present a navigation system that has a memory that stores traffic information, a controller that creates prediction traffic information based on the traffic information stored in the memory, searches a plurality of routes to a destination, calculates a predicted passage time of each link in each route, obtains for each link prediction traffic information at the predicted passage time, based on the created prediction traffic information, and extracts the obtained prediction traffic information pertinent to route searching as information to be distributed, according to a predetermined order of priority. It also creates prediction traffic information by creating short-term prediction link travel time patterns and prediction traffic information including congestion prediction information. The controller creates prediction link travel time patterns based on link travel time patterns stored in the memory. However, they do not describe how all this topographical and online information could be efficiently used in route searching algorithms with the purpose of providing precise driving instructions.

Montealegre et al., 2005 (US Application 2005/0102098) describe vehicle navigation system capable of learning user habits and preferences, correcting mistakes in a digital map database, and adding new roads that may have been constructed after release of the digital map database is disclosed. The vehicle navigation system may also monitor the geographic position of the vehicle and allow the driver to update or change data contained in the digital map database if an error exists, and is also capable of learning new roads that are not included in the road network map of the digital map database.

The system may have considerable advantages especially for certain drivers but it does not preempt the present invention with its real time dynamic facilities for fastest route search.

Tzamaloukas, 2005 (U.S. Pat. No. 6,925,378) describes an enhanced mobile communication device that communicates with the geographic database for computing routes, paths, and turn-by-turn directions and calculates multiple routes and suggest alternatives using current road congestion conditions.

Other well known examples of live navigation such as ADVANCE (http://ais.its-program.anl.gov/advance/reports/REPORTS.HTML/8460-04/main.html#SECTION 0002000000000000000) use travel time prediction algorithms and road detectors with probe vehicle reports for travel predictions. Due to large costs involved these systems provide coverage for major road links only. The systems do not combine system-wide traffic control with navigation for combined advantage. The traffic control system does not apply navigation as a part of overall strategy to re-direct plurality of users to less blocked-up areas and thereby try to improve overall traffic flow in the entire network. Similarly, while recommended speeds are used in prior art (see US 20050140523) and others as means of driver information, these do not use navigation as a part of traffic control optimization system strategy.

PRIOR ART CONCLUSIONS

Saturated traffic control is a task for multilevel and multiobjective management system. On one level the objective is to develop a highly flexible and adaptive local traffic control system functioning well in normal and heavily congested traffic as a stand-alone mechanism for regulating local traffic on single intersections. On the other hand even the most efficient single traffic light is only a small part of the overall traffic network control. The optimal network system should therefore be able to perform centrally controlled dynamic traffic coordination functions such as optimization of a plurality of traffic lights simultaneously in order to avoid blocking-up of current traffic flows between two or more independent traffic lights, where the optimal green times for a single traffic light may have to adapted to accommodate current traffic congestion direction on next TLs. Both levels of multiobjective optimization and coordination require live traffic congestion data prior to traffic light cycle computations. Live data to the individual traffic light is easier to provide locally as shown in prior art but the central network traffic control requires comprehensive live traffic coverage data even more urgently. The traffic data collection must be comprehensive to be really applicable in the dense urban networks but still economically feasible to be viable on large scale.

Additionally, all traffic network users such as drivers, passengers and general public are also important factor in optimal traffic control. The ideal traffic control system should provide live congestion updates and dynamic route guidance to the drivers before they enter the saturated traffic areas thereby reducing traffic demand in these regions.

PATENT SUMMARY AND COMPONENTS

It is an object of this invention to provide a comprehensive real time multiobjective management system for traffic control on both local and network level for optimization of entire congested traffic networks and to provide real time traffic route alternatives for drivers to avoid congested traffic zones. The system utilizes local traffic light video cameras for live data collection and performs image brightness analysis to compute current traffic loads on all TL approaches.

Traffic data collection in large urban areas is also made possible via remote airborne cameras and high resolution satellite radars such as synthetic aperture radar (SAR) and inverse synthetic aperture radar (ISAR). The system uses adaptation of the image brightness analysis to compute vehicle congestion on larger traffic areas covering 10-15 km radius simultaneously.

At the $1^{st}$ stage, the local traffic control system optimizes individual traffic-light control. The local TL controller microprocessor computes allocation of green times for each intersection cycle, the current travel times and recommended speeds on all adjacent approach links.

In the second stage multiobjective optimization the local traffic controller dynamically updates central traffic control server. The main function of the central server is to perform the network coordination of a series of individual TLs and their green times according to the current network congestion and to adjust green times of individual TLs when required. Whenever possible the server also optimizes green-wave TL coordination in other saturated directions. At the $2^{nd}$ stage optimization the server recalculates optimal travel times at individual intersections and green-wave coordination between series of traffic lights and computes recommended speeds on all link directions.

The coordinated live traffic data from central server is then updated and broadcasted to all local controllers and to the on-line connected client vehicle guidance units. These units can perform custom searches for route re-planning based on current dynamic route guidance. Continuous broadcasts to plurality of drivers are also made directly to the roadside monitors or hand-held units according to their geographic positions.

In this way the server applies dynamic traffic guidance as another component in traffic control system.

Client on-vehicle navigation units perform another function in this system. The typical unit includes on-line traffic-responsive route guidance software with a novel time-dependent modification of an A*-type algorithm for fastest route searches to further reduce traffic congestion loads. Statistical travel time tables, dynamic current travel time tables and predicted estimated travel times are all utilized for on-vehicle fastest route searches. Dynamic travel information like recommended speeds to reach next intersection and preferred green wave directions are also displayed on road side monitors to plurality of drivers approaching the intersection. In this way, more drivers can be reached in real time. The centrally coordinated on-line traffic control system stores all traffic data, updates statistical tables and creates dynamic rolling horizon travel time prediction tables. The on-line guidance to plurality of vehicles thus also serves as another tool in traffic management, local traffic dispersion of vehicle concentrations on specific locations and re-direction of plurality of vehicles away from congested links and traffic intersections.

BRIEF DESCRIPTION OF THE DRAWINGS

FIG. 3*b* Video Image of 3D-TL Layout

DETAILED DESCRIPTION OF THE PREFERRED EMBODIMENT

System Components

Figure 1:
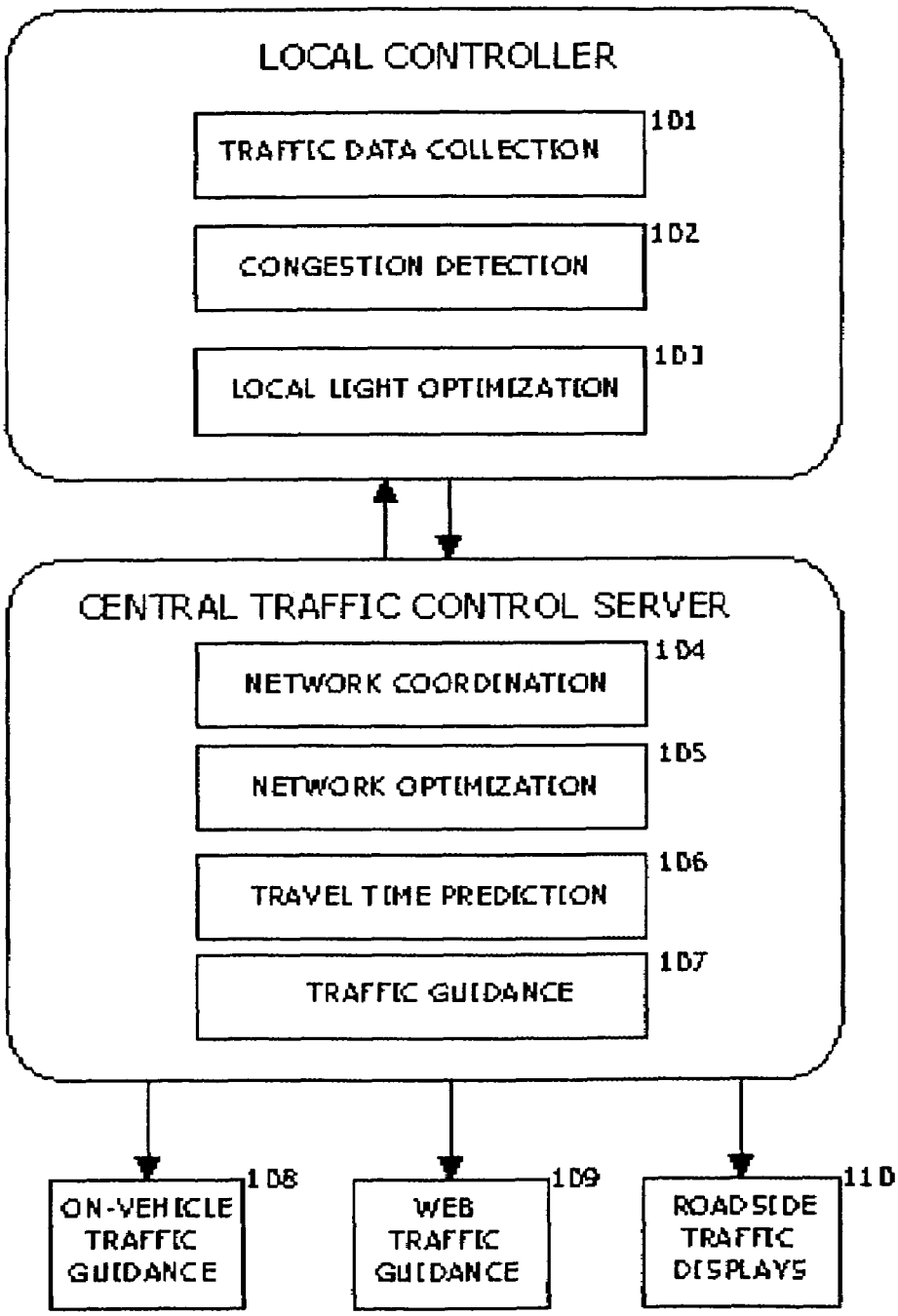
FIG. 1 System Components: Network Traffic Control Configuration

FIG. 1 shows main system components of the proposed invention describing local and network traffic control configurations including:

Local controller functions:

Traffic data collection (101)

Congestion detection (102)

Local $1^{st}$ stage optimization functions (103)

Central server functions:

Green wave coordination (104)

$2^{nd}$ stage network optimization (105)

Recommended Travel Time Prediction (106)

Traffic Guidance (107)

On-vehicle traffic guidance (108)

Web on-line traffic guidance (109)

Roadside traffic advisory displays (110)

Figure 2:
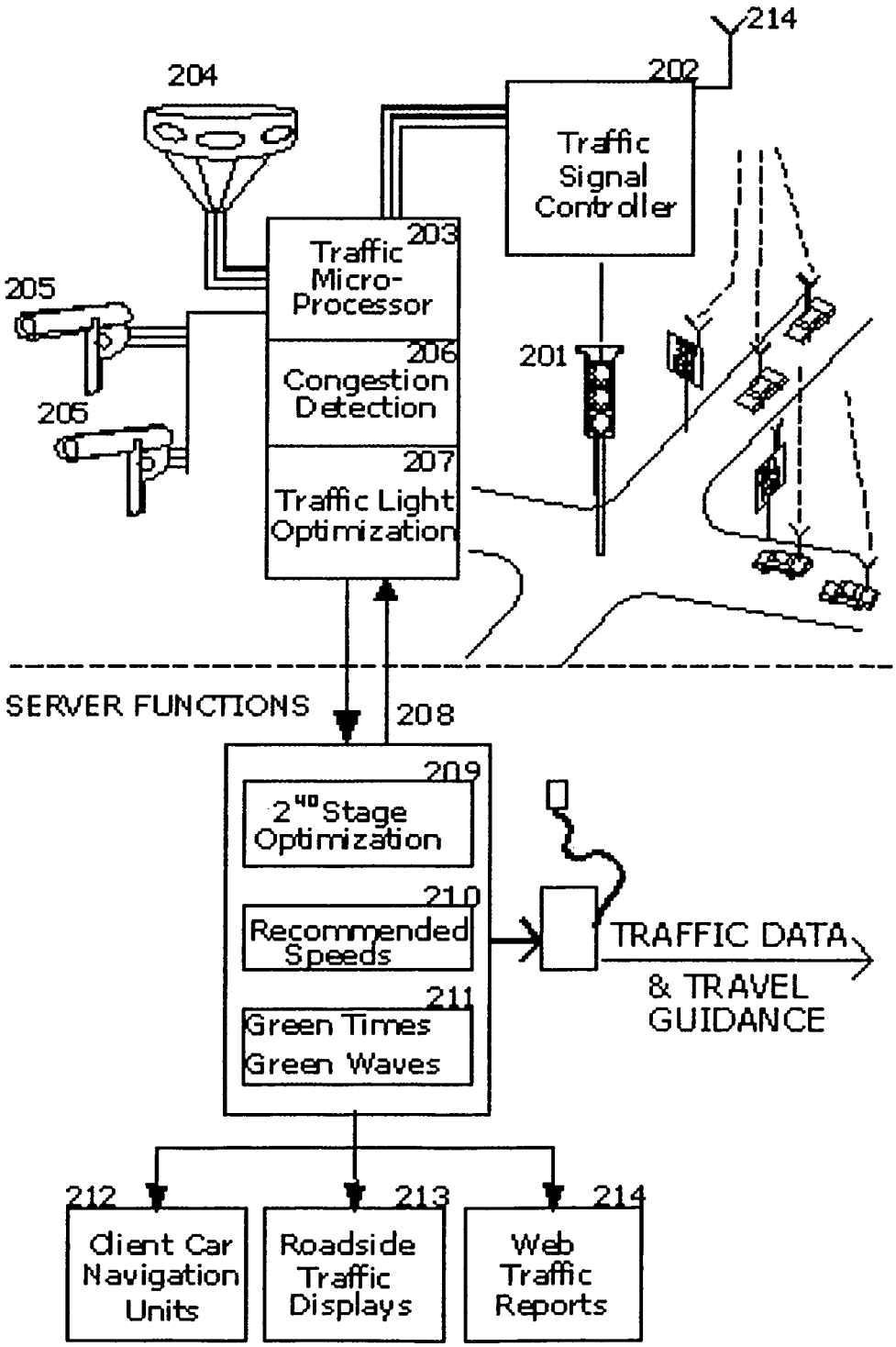
FIG. 2 Local Controller and Central Server Functions

Local Controller and Central Server:

FIG. 2 shows a block diagram of various components of the proposed multiobjective system and a method for controlling of at least one local traffic light (201). Traffic light (TL) at an intersection (201) is connected to traffic signal controller (202) for controlling traffic light program. Local microprocessor (203) has a logical connection to the traffic light controller and comprises video processing module (204) connected to video image collection and processing unit. This unit comprises at least one low-cost 360 panorama digital camera (204) with other optional single camera inputs (205) for more varied or detailed views, depending on topological characteristics at the intersection. Traffic cameras are used for acquiring dynamic digital image sequences of traffic data on the TL.

The image analysis with the congestion detection on specially designated approach and exit regions are performed in step (206) The microprocessor also contains a traffic light optimization unit (207) with software algorithm for optimization of current cycles, green times on each direction, recommended travel speeds etc. A local database stores current optimization data and said video image analysis. The microprocessor has an on-line two-way communication link to the central server (208) to enable real time traffic data transmission to central server and control timing data of at least one or more local TL controllers. Local server receives modified cycle lengths, green time starts and recommended speeds computed and adjusted by $2^{nd}$ stage server network optimization. The local traffic controller may also include separate radio transmitter and receiver (214) for transmitting traffic control data to and from vehicles equipped with similar two-way transmitters.

Central Server Control Functions

The central traffic control server (208) has a remote control link to at least one local traffic light comprising a system and method for central network traffic control optimization and coordination module for a two-level network traffic light optimization (209). The traffic control server module computes and adjusts green time group start-times, green-waves and recommended speeds on TLs in the network and sends out data packs to individual TL controllers (202) as required by coordinated traffic control. The traffic server is logically connected to on-line traffic navigation and client guidance system (210) which comprises means for updating client on-vehicle traffic navigation unit-databases (211) with recommended speeds, cycle durations, green waves and other live traffic data. The traffic server system also comprises communication means such as landlines or web links for updating the said navigation data to roadside traffic monitors (212) and other traffic advisory display systems (213). The control server module can also send out live travel data packs via local radio transmissions (214) to radio connected on-vehicle navigation units.

The main emphasis in the present invention is on dynamic vehicle congestion processing on all TL approach and exit directions. Ignoring the congestion loads after TL in heavy congested traffic will often result in "jam" congestion increase, adding more vehicles onto already saturated exit lanes. While other systems use vehicle loads on "stop lines" on lanes before the TLs, the present system performs traffic congestion analysis on all approaches before and after TLs for currently optimal green times.

Other standard traffic surveillance data inputs from roadside counters and statistical tables may be also included in the computations.

Traffic Data Collection

Live traffic data streaming from TL traffic cameras are stored locally on controller database. Compressed bitmap images from video and digital cameras are collected in short time sequences, i.e. one image/sec for near real time processing locally and are also stored on central server database including Geographical Information System (GIS) reference data such as local coordinates, time, etc. All cameras have average recording range of 150-200 meters and are located on central location typically above the TL intersection according to operator specifications. In the preferred embodiment the use of inexpensive digital cameras or single 360 degree panorama cameras may result in significant cost reduction in the overall system. The operator calibrates camera views for each travel direction to enable full surveillance of the entire intersection. Additional cameras may be added if necessary due to intersection topography. Monitoring of all cameras and their performance is from remote central traffic location or locally as required. All processing is in real time with direct output to each TL controller.

Traffic data collection in large urban areas is also made possible via remote airborne cameras and high resolution satellite radars such as synthetic aperture radar (SAR) and inverse synthetic aperture radar (ISAR). The system uses adaptation of the image brightness analysis to compute vehicle congestion on larger traffic areas covering 10-15 km radius simultaneously.

In this embodiment we present single TL and traffic camera configuration for local vehicle loading computations. On the larger urban scale the loading computations are done on a plurality of TLs at the same time.

Figure 3:
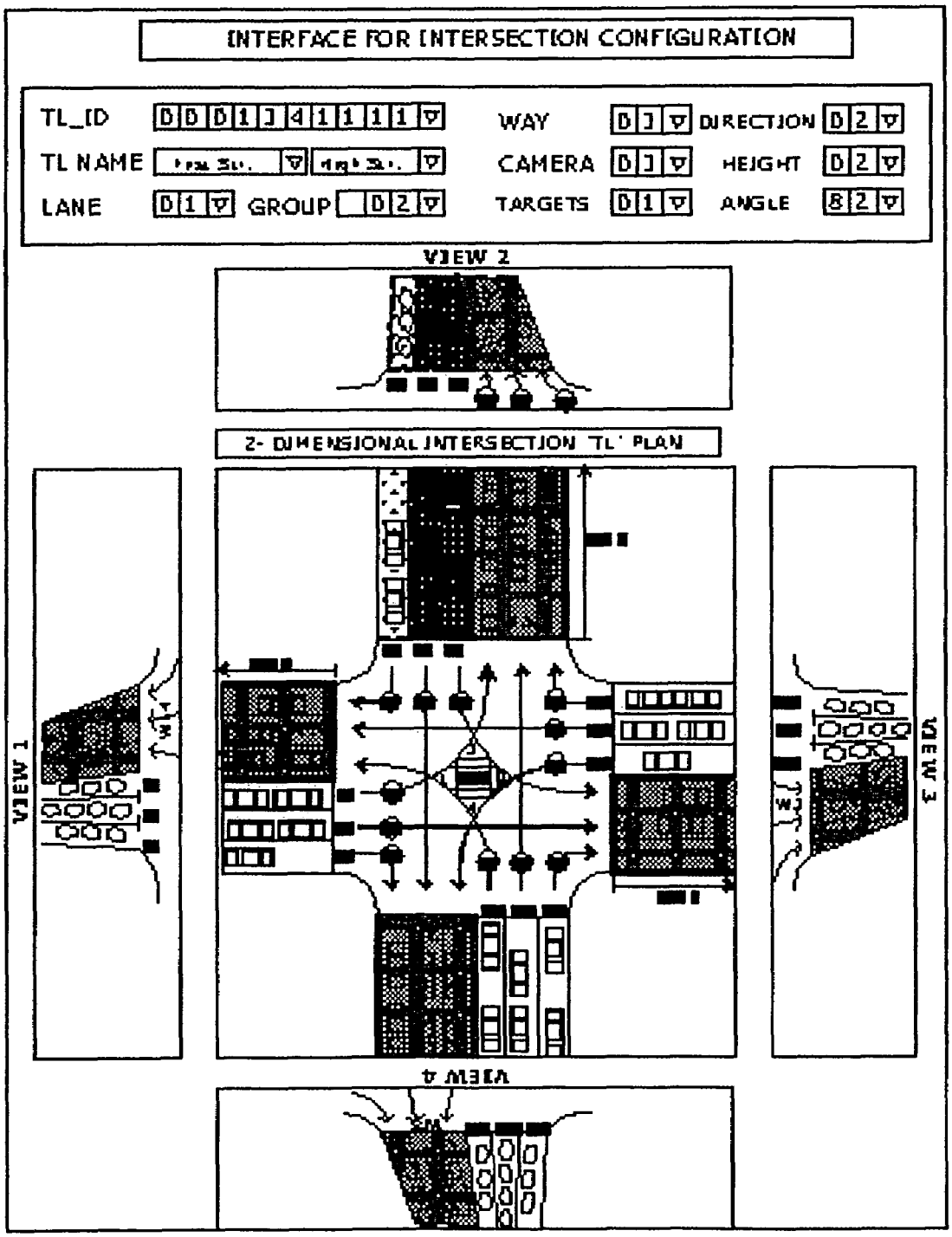
FIG. 3 Interface for Intersection Configuration

FIG. 3 shows a typical 4-way TL intersection plan with GIS enabled graphic user interface inputs. It shows one centrally located panorama camera with 4 views $CAM_{1,2,3,4}$ covering all directions of the TL including approaches in all 4 directions (North, South, East, West). Each direction comprises number of road approach lanes $L_1, L_2, \ldots, L_n$ and exit ways $W_1, \ldots, W_j$ respectively. For traffic congestion computations each lane is further defined by a polygon boundary of the lane width say 3 meters and length of say 150 meters. Exit ways $W_j$ are also defined by a polygon boundary and may contain one or more lanes per each exit, as designated by the operator.

In the system initiation stage the operator configures TL intersection using standard input interface. The operator selects appropriate geometrical layout from various intersection templates such as 2-way, 3-way, 4-way etc. and assigns allowable speeds for all road sections. The operator also assigns vehicle groups that will move during the same green time interval. Groups are designated here as Gr1, Gr2, Gr3 and Gr4 and will represent vehicle queues on individual lanes and their travel directions of the TL.

All camera views are designated by CAM ID number, camera height, azimuth and angle. Recommended heights range between 10-15 meters for unobstructed views of queues of 150-200 meter lengths.

Using TL layout interface allows the operator simple means of data entry as well as uniform system of intersection designation. The FIG. 3 also shows 3-dimensional camera view 1, 2, 3 and 4 of the TL for all direction approach and exit lanes coordinating plan and view template designations.

FIG. 3*b* shows an existing TL camera view of with a 3D layout template. Lanes L1,L2,L3 and L4 designate approach lanes before TL and exit ways W1,W2,W3 and W4 after TL as defined by the operator in the TL configuration stage. Several views may be combined to provide full coverage of an existing intersection.

Traffic congestion measurement and Image Heterogeneity Analysis (Module)

This module uses image sequences from a TL video camera views to measure traffic congestion by means of image brightness heterogeneity (IBH).

The main objective of the brightness heterogeneity analysis method is to define pixel brightness variance of an image pixel strings inside the user-designated boundary polygon regions. In this analysis the regions represent approach lanes or exit ways of the intersection and are selected by the operator to asses the current traffic congestion in these areas. The amount of traffic congestion on the TL approach lane can be expressed as a degree of pixel brightness variance (heterogeneity) in the image relative to the last learning calibration period (say 15-minutes) and the minimum "learning" value obtained in that period, which the system now sets as its current "empty" or "zero" congestion level for the given region.

The color image is comprised of number of pixel-strings in the horizontal and vertical array i, j. In this patent, we define a single pixel string as a contiguous sequence of pixels in one row or one column, where the difference between the initial pixel brightness value B and each internal pixel brightness B-value does not exceed the preset tolerance level (TOL). The image brightness heterogeneity (IBH) may be defined as a sum of all pixel strings whose B-values exceeded pre-set TOL value. Experimentally we found that TOL=30 variance between two pixel strings gives the closest approximation of significant variance in the image heterogeneity for estimating traffic congestion changes.

While the color images may be also defined by their color hue H and color saturation S, besides the color brightness B, (HBS) in this invention only the pixel brightness B coefficient is used for image analysis resulting in simplified computing process.

Note: In all color images the pixel B coefficient ranges between values $0 \leq B \leq 255$.

Figure 4:
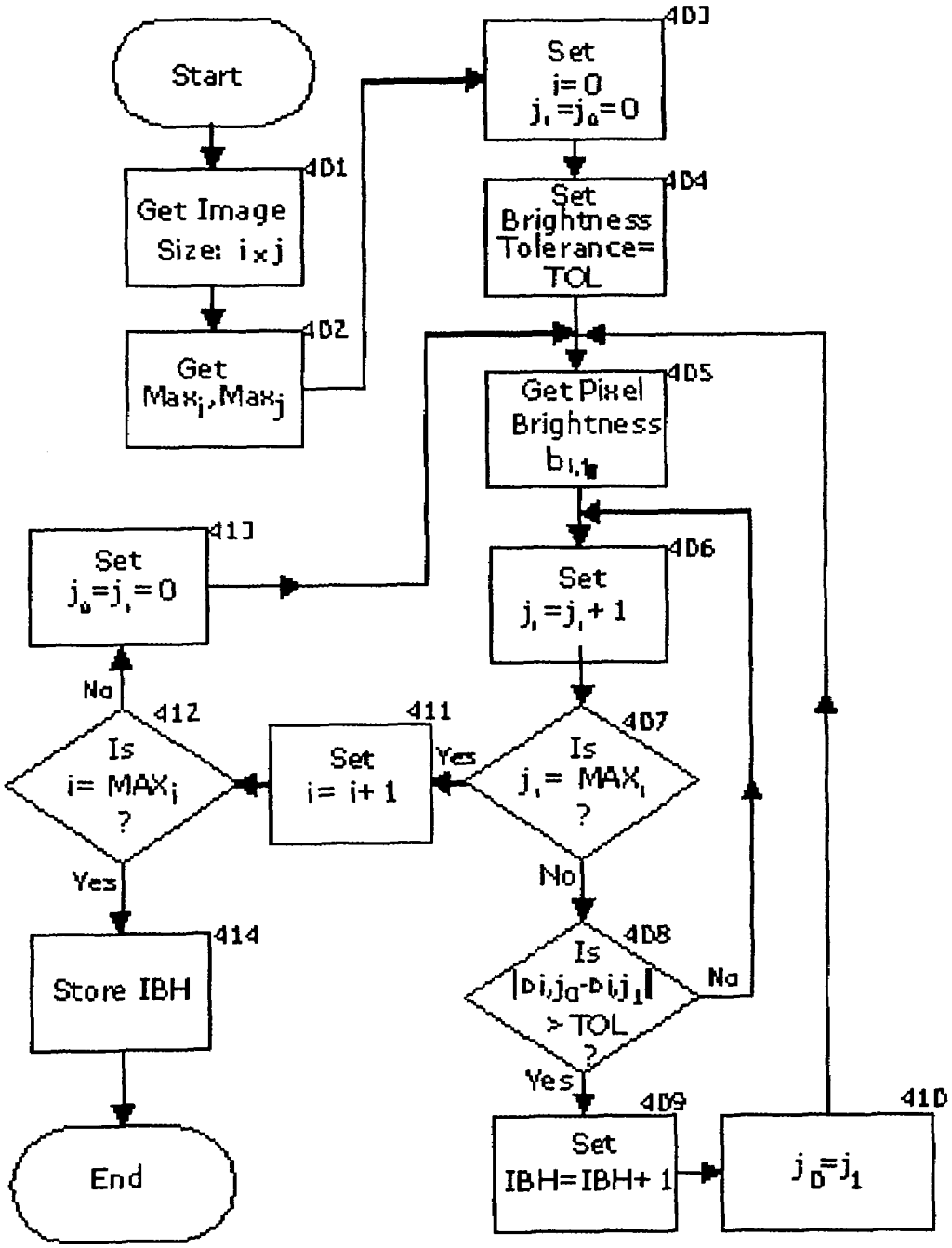
FIG. 4 Flowchart of brightness B computation

FIG. 4 shows a flowchart diagram of the method of computation of image brightness heterogeneity IBH or "B" for short, of the image.

Step 401: Get digital image size i×j with typical resolution say 640×480 pixels where each image is represented by a matrix of pixels with 480 rows and 640 columns.

Step 402: Get $Max_i$ pixel rows (i.e. 480) and $Max_j$ pixel columns (i.e. 640).

Step 403: Set first row i=0 and first column $j_0=j_1=0$ where $j_0$ is the initial pixel of current string and $j_1$ is next pixel of the current string;

Step 404: Set brightness heterogeneity tolerance value TOL.

Step 405: Get brightness level of initial pixel in first row $B_{i,j_0}$.

Step 406: Get brightness level of next pixel in first row $B_{i,j_1}$

Step 407: Verify if the last pixel in the row has been reached where $j_1=Max_j$ Step 408: Verify if absolute difference in brightness between current and initial pixel exceeds TOL value $|B_{i,j_0}-B_{i,j_1}|>TOL$.

Step 409: If step 408 is TRUE then

Add 1 to total current B image brightness heterogeneity value in the row.

Go to step 410;

Step 410: Set the last B as a start point and computes the next pixel B

Return to step 405;

Step 411: If the last pixel in the row on the last column has been computed, advance to the next row.

Step 412: Verify if current pixel is in last row and last column i.e. $Max_i$ and $Max_j$ has been reached.

Step 413: Advance to next column till the total B for the image has been computed.

Step 414: Store the image final B value and ends the program.

Figure 5:
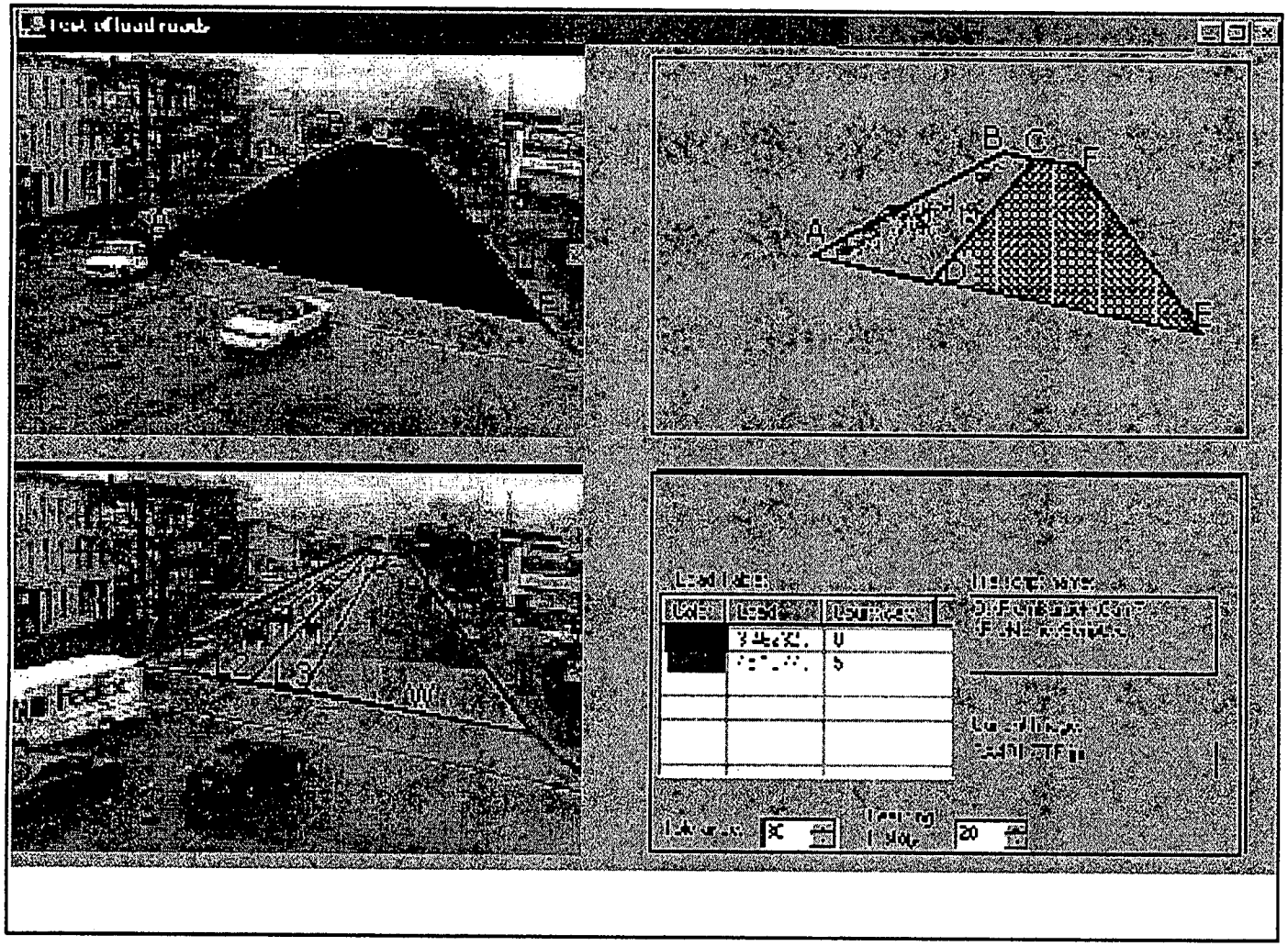
FIG. 5 Graphic User Interface

FIG. 5 shows is an example of graphic user interface of typical intersection in traffic camera view. The B values of series of image bitmaps of the TL view are computed for a short initial calibration period T say 15 minutes. This period is a learning history parameter used by the system to establish calibration B values for the present reading. The operator can set the duration length of the learning period with average frequency of say 1 image per second. The system uses 2 polygons ABCD and DCFE pre-defined by operator in 2D plan view in FIG. 3. and fills the said polygons with single colors i.e. red and green etc. for easy boundary recognition. The operator can adjust brightness tolerance TOL threshold of say, B=30. Below this value the initial calibration designates an "empty" lane. The system finds $B_{max}$ and $B_{min}$ values for all images in period T and records B variance in the database. A separate template table of vehicle occupancy levels based on the B variance is used to estimate number of cars for the given polygon region ranging from minimal occupancy to the current maximum according to operator input.

The higher value of B indicates higher presence of cars. For example B value 4 may signify 1 car count, value 8 two cars etc. In this manner the operator can visually update car count template determining car multiplier value for car counts for current period T. The image parameters are re-evaluated periodically and car multiplier value re-adjusted as necessary. Factors such as time of day, weather and lighting conditions may influence car count results and the system updates the present car count template from previous rolling history values. To compute the car count in the current image for camera view CAM 1 the system first calculates current brightness coefficient value B, obtains last car multiplier factor and estimates current car count accordingly.

System Input Module

The input module routine verifies the available lists of TL intersections included in the network optimization and examines approach lanes and exit ways on each link, their main group directions and group designations. All available TL camera views and their configurations are also examined by this routine. The operator sets maximum waiting time parameter for each green light including crossing times for pedestrians as necessary, and the maximum allowable speeds for each road link.

Figure 6:
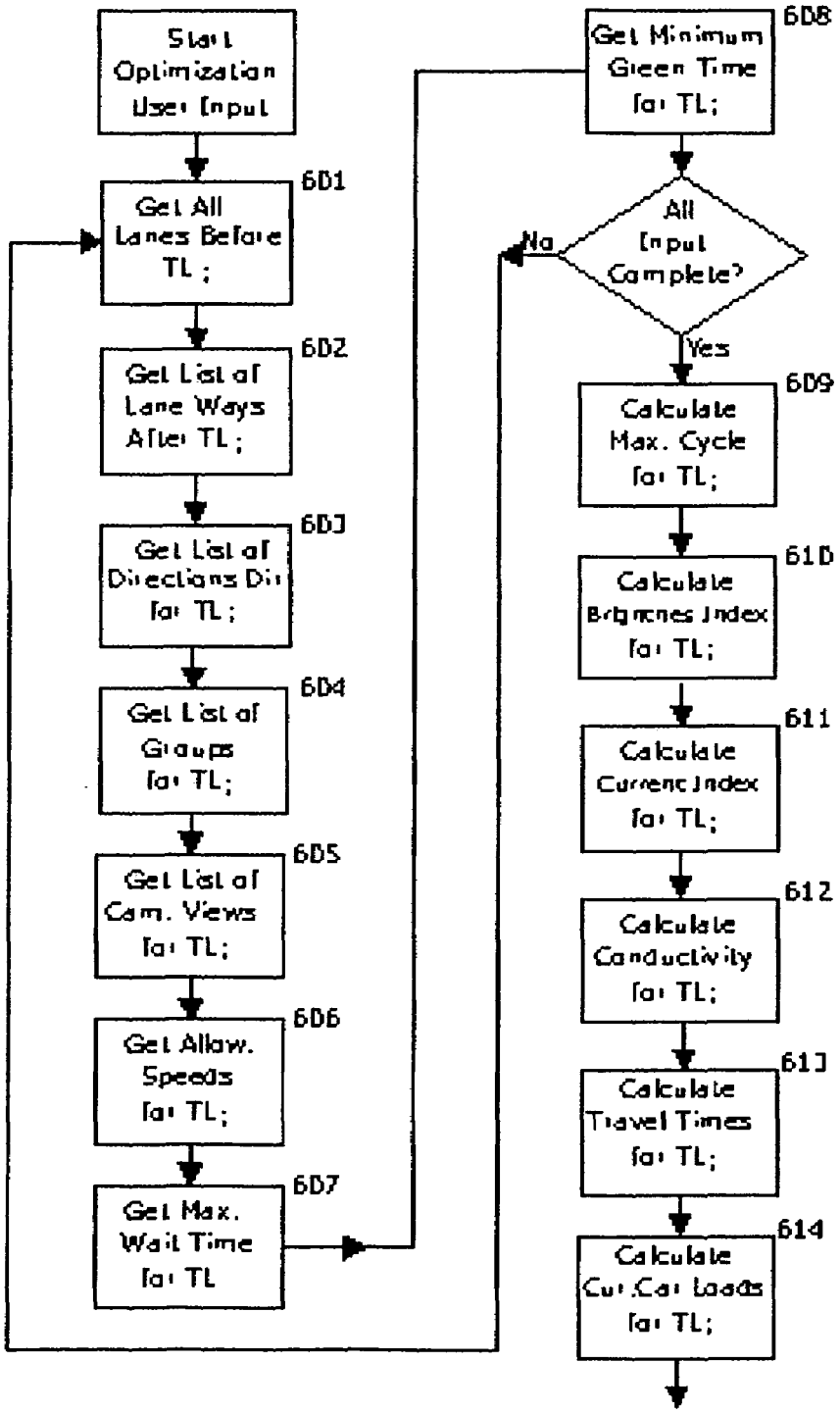
FIG. 6 $1^{st}$ Stage Optimization—User Input

FIG. 6 shows input steps for $1^{st}$ stage optimization using typical plan of intersection TL shown in FIG. 3. Input module routine of the above example comprises following steps:

Step 601: Get all lanes on 4 approaches before TL:

Approach 1: $L_1,L_2,L_3$, Approach 2: $L_7,L_8,L_9$, Approach 3: $L_{13},L_{14},L_{15}$, and Approach 4: $L_{19},L_{20},L_{21}$.

Step 602: Get all exit ways $W_2$, $W_8$, $W_{14}$, $W_{20}$ after TL, where each $W_j$ defines a polygon area containing set of lanes on exits after TL, using the middle lane before TL as the dominant feeding lane of the exit way, i.e. $L_2$ is dominant lane of Approach 1 feeding to $W_2$, etc.

Step 603: Get all traffic directions $N^{dir}$ for TL as defined by operator in the preprocessing stage, where each direction $Dir_{ij}=(L_i,W_j)$ comprises lane $L_i$ before TL feeding exit way $W_j$ after TL. In this method the system connects traffic flow of vehicle queues on lanes before TL with current vehicle queues on exit ways after TL.

Step 604: Get list of groups of each TL, where a group $Gr_n$ is defined as a set of all allowed directions $Dir_{ij}$ on the same green light.

Example in FIG. 3 shows 4 groups:

Group $Gr_1$={(1,8), (2,2), (13,20), (14,14)};

Group $Gr_2$={(3,20), (15,8)};

Group $Gr_3$={(19,2), (20,20), (7,14), (8,8)};

Group $Gr_4$={(21,14), (9,2)} where $(L_i,W_j)$ is simplified to (i,j).

Step 605: Get list of camera views 1,2,3,4 of TL where camera CAM1 shows Approach 1 lanes $L_1,L_2,L_3$ and the exit way $W_2$ and CAM2 Approach 2 lanes $L_7,L_8,L_9$ and the exit way $W_{20}$, etc.

Step 606: Get allowable speeds on all lanes before and after TL, where allowable speeds on lanes before TL: $V_i$ and exit way after TL: $V_j$ Step 607: Get approach-lane maximum waiting time $Wt_i^{Max}$ (e.g. $Wt_i^{Max} \leq 3$ min) according to the importance for this approach travel direction and hour of the day.

Step 608: Get Minimum Green Time=$G_i^{Min}$ for TL $i^{th}$ approach obtained by equation: $G_i^{Min}=RoadWidth_i/V_{PEDESTRIAN}$ where $V_{PEDESTRIAN}$ is minimum pedestrian crossing speed in seconds required on this road and hour of the day and $RoadWidth_i$ is the road width in meters.

Step 609: Calculate maximum cycle length $C^{max}$ for TL.

In this step the system calculates maximum cycle length for TL based on two values:

a) minimum of maximal waiting time $Wt_i^{Max}$ on approach direction i b) maximum of minimal green time value $G_i^{Min}$ on direction i.

$$C^{Max}=\min_j Wt_j^{Max}+\max_j G_j^{Min}, j=1,2,\ldots,N^{Dir}$$

Step 610: Calculate Index of Brightness Heterogeneity B for each TL.

Two images are analyzed for each direction at time t:

$B_i^{Bt}$ is brightness of lane region $L_i$ before TL, and $B_j^{At}$ is brightness of exit way region $W_j$ after TL, maximal and minimal indices during specified time interval are as follows:

$$B_i^{B,Max}=\max_t B_i^{B,t}, B_j^{A,Max}=\max_t B_j^{A,t},$$

$$B_i^{B,Min}=\min_t B_i^{B,t}, B_j^{A,Min}=\min_t B_j^{A,t}, i,j=1,2,\ldots,N^{Dir}.$$

Since the system must obtain at simultaneously both "empty" road and "road full" status, the B values for the current lighting and shade conditions of the intersection, TL, it is important to filter out any local light disturbances. For the same reason it is necessary to keep the calibration period short, say 15 minutes. We calculate brightness ranges of lane $L_i$ before TL and of exit way:

$$B_i^{B,Var}=B_i^{B,Max}-B_i^{B,Min}$$

$$B_j^{A,Var}=B_j^{A,Max}-B_j^{A,Min}$$

Step 611: Calculate current brightness heterogeneity indices $B_i^{B,Cur}$, $B_j^{A,Cur}$ of TL.

Step 612: Calculate current traffic conductivity $D_i^B$ before TL and $D_j^A$ after TL.

$$D_i^B=1-(B_i^{B,Cur}-B_i^{B,Min})/B_i^{B,Var}$$

$$D_i^A=1-(B_j^{A,Cur}-B_j^{A,Min})/B_j^{A,Var}$$

Traffic loading expresses number of vehicles on approach lanes of TL in terms of image polygon brightness.

Step 613: Calculate Current Travel Times T for $Dir_{ij}$ before and after TL;

In this step we compute current travel times for the TL in order to maintain and update the Travel Guidance Server Database which provides route guidance to all real time users. Travel time for individual lanes and exit ways after TL can be computed as follows:

$$T_i^B = \frac{S_i^B}{V_i^B D_i^B},\ T_j^A = \frac{S_j^A}{V_j^A D_j^A}$$

where $S_i^B$,$S_j^A$ are distances from TL to previous TL and next TL.

$V_i^B$ and $V_j^A$ is current vehicle speed before and after TL:

$V_i^B=V_i^{B,allow}D_i^B$ and $V_i^{Real,A}=V_i^{A,allow}D_i^A$ before and after TL.

$V_i^{B,allow}$, $V_i^{A,allow}$ are allowable speeds on lanes.

Step 614: Calculate current number of vehicles on TL travel direction $Dir_{ij}$ comprising number of vehicles before and after TL for direction $Dir_{ij}$:

$$C_i^B = \frac{S_i^B}{(V_i^B D_i^B / S_d) \cdot L_{car} + L_{car}}$$

$$C_j^A = \frac{S_j^A}{(V_j^A D_j^A / S_d) \cdot L_{car} + L_{car}}$$

where $L_{car}$ is average length of car and $S_d$ is recommended safe-following distance at speed V.

In addition the system can compute number of vehicles currently on each TL used for various historical and current traffic studies.

1st Stage Optimization Module

Figure 7:
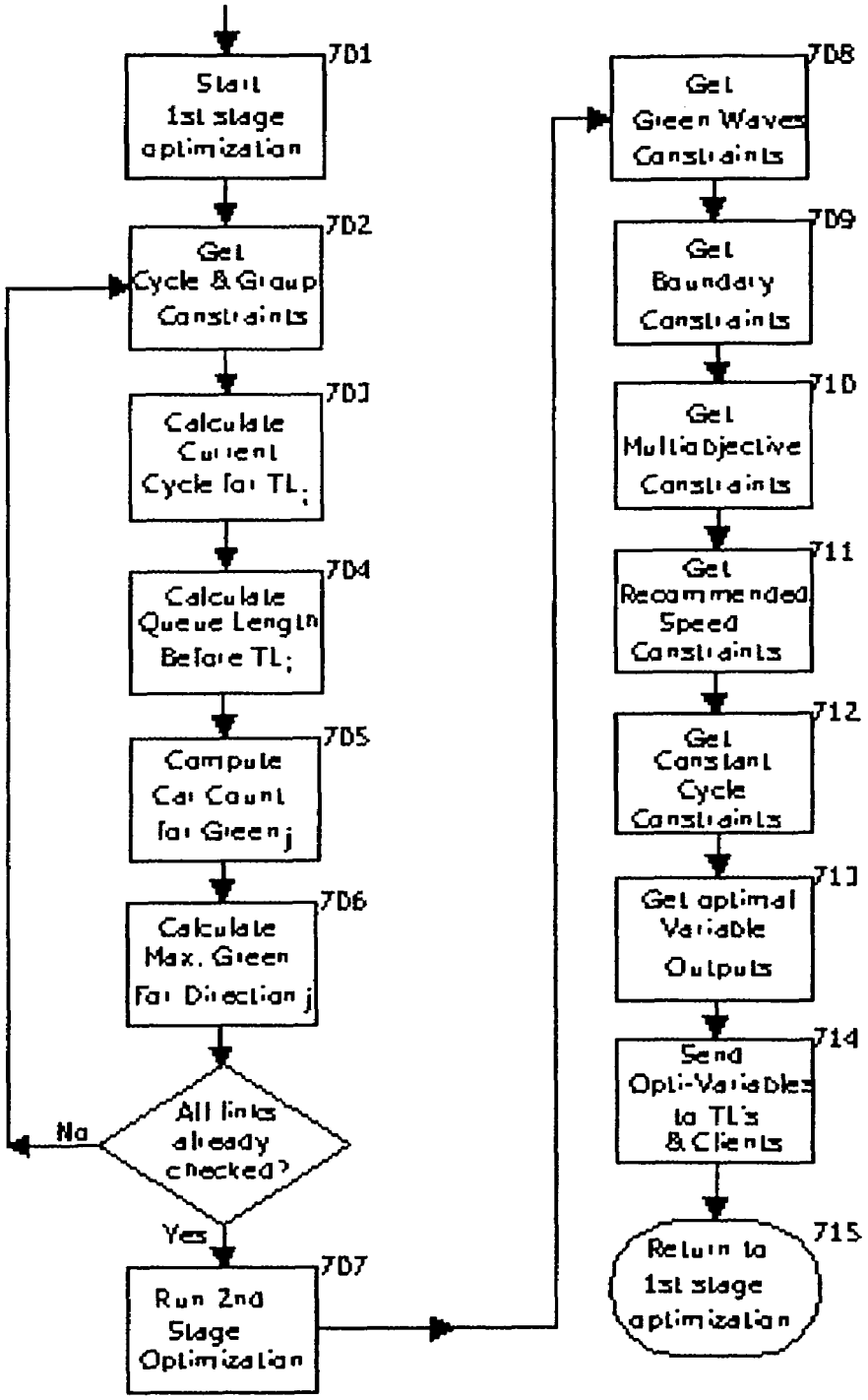
FIG. 7 $1^{st}$ and $2^{nd}$ Stage Optimization Flowchart

Step 701: in FIG. 7 performs green phasing and timing optimization. Our goal is to maximize number of cars that will clear TL in all allowed directions during current cycle, i.e. to maximize Objective function $\Sigma G_j K_j$ where $K_j$ is number of cars that will clear TL for direction $Dir_{ij}$ per second, and $G_j$ is unknown green time for direction $Dir_{ij}$ Subject to:

Min green constraints $$G_j \geq G\min, j=1, \ldots, 12$$

and Max green constraints $$G_j \leq G_j^{max} = T_j^{Wait} + T_j^{Go}.$$

Here $T_j^{Wait}=C_j^B\Delta t$ and $$T_j^{Go} = \frac{Q_j}{V_j^{Real,A}/2} = \frac{2Q_j}{V_j^{Real,A}}$$

where $C_j^B=Q_j^B/(L_{car}c)$ is number of vehicles in queue $Q_j^B$, $$C_i^B = \frac{S_i^B}{(V_i^B D_i^B / S_d) \cdot L_{car} + L_{car}}$$

$$C_j^A = \frac{S_j^A}{(V_j^A D_j^A / S_d) \cdot L_{car} + L_{car}}$$

$\Delta t$ is a delay interval between two adjacent cars starting to move one after another after green light signal has been activated, $Q_j$ is queue length on direction $Dir_{ij}$ before TL, $T_j^{Wait}=Q_j^B/(L_{car}c)\Delta t$ is a waiting time of all queued vehicles for each delay $\Delta t$, $T_j^{go}=G_j-T^{Wait}$ is time interval for last car in the queue $Q_j^B$ to clear TL during green light.

Groups constraints are $G_j=G_k$, if directions j,k belong to same group $Gr_n$.

For example: Let directions (1,8), (2,2), (13,20), (14,14) all belong to group $Gr_1$, so that they share the same green light which designated by $G_1=G_2=G_{13}=G_{14}$ Cycle constraints are $$\sum_j G_j / k_j = C^{cur}$$

where $k_j$=number of directions in a group that includes direction j.

Step 702: Get cycle and groups constraints:

Step 703: Calculate current cycle $C^{Cur}$ length:

$$C^{Cur}=C^{Max}\cdot B_{Cur}/B_{TL}$$

where $B_{TL}=\max_j(B_j^{Max})N^{Dir}$ and $$B_{Cur} = \sum_{j=1}^{N^{Dir}} B_j^{Cur}$$

$B_j^{Max}$ means $B_i^{B,Max}$ or $B_j^{A,Max}$ $B_{Cur}$ means $B_i^{B,Cur}$ or $B_j^{A,Cur}$ Step 704: Calculate queue lengths for direction $Dir_{ij}$:

$$Q_i^L=C_i^B L_{car}c \text{ and } Q_j^L=C_j^A L_{car}c$$

where c is recommended safe-following distance at speed V i.e. it is a gap factor by which the car length $L_{car}$ is multiplied in a queue that is before TL red light $C_i^B$, $C_j^A$ are number of vehicles in queues before and after TL $L_{car}$ is average length of vehicle Step 705: Calculate number of cars $K_j$ that will clear TL for direction $Dir_{ij}$ per second $$K_j = \frac{V_j^{Real,A}}{2L_{car}c + V_j^{Real,A}\Delta t} \quad \text{a)}$$

$\Delta t$ is starting-time delay between adjacent vehicles $V_j^{Real,A}$ is real speed after TL measured in m/sec Step 706: Calculate max green light per direction $Dir_{ij}$, for example if:

$$C_J^B=20, L_{car}=3, c=1.5, V=10 \text{ m/s}, \Delta t=0.5 \text{ sec}$$

$$G_j \leq 20*(3*1.5*2/10+0.5)=20*1.4=28 \text{ sec then:}$$

$G_j$ is a time needed for passing 20 vehicles that were stopped before TL

2nd Stage Optimization and TL Coordination Module

The purpose of 2nd stage optimization is to compute optimal green wave network coordination of start times of sequential green lights of groups of oversaturated TL intersections subject to green wave and recommended speed constraints. Current optimal green light times and cycles from linear optimization in $1^{st}$ stage are used as input constraints in the next stage coordination. The multiobjective paradigm is defined as simultaneous optimization of several, often conflicting, design objectives such as adjustments of allocation of green times control variables computed for $TL_i$ in $1^{st}$ optimization stage.

Step 707:

Maximize the objective function $$\sum_{i=1}^{N^{TL}} \sum_{j=1}^{N^{Dir}} C_{i,j}^{B} V_{i,j}^{next}$$

where $C_{i,j}^{B}$ is number of vehicles on direction $Dir_j$ before $TL_i$ from $1^{st}$ stage optimization The control variables in this problem include $V_{i,j}^{next}$ and additional variables that do not enter explicitly into the objective function (have zero coefficients).

$V_{i,j}^{next}$ is recommended speed on direction $Dir_j$ after $TL_i$.

The additional control variables are as follows:

$t_{i,j}$ is start time of next group of green light for $Dir_j$ at $TL_i$;

$t_{i,j}^{next}$ is start time of current group of green light $TL_{next}$ after $TL_i$ in direction that continues $Dir_j$;

$t_{i,jNext}^{next}$ is start time of next group of $TL_{next}$ after $TL_i$;

$\chi_{i,j}$ is binary: 0 means current cycle, 1—next one;

$G_{i,j}$ are control variables for green times approximately computed for $TL_i$ in $1^{st}$ optimization stage. They could receive corrected values at the $2^{nd}$ stage of optimization;

$\delta_{i,j}$ are nonnegative control variables that relate two stages of the optimization.

The objective function above is maximized subject to the following constraints:

Step 708: Get Green wave constraints for saturated direction zones:

$$t_{i,j}+d_{i,j}/V_{i,j}^{next}>t_{i,j}^{next}+\text{Cycle}_i\chi_{i,j};$$

$$t_{i,j}+d_{i,j}/V_{i,j}^{next}>t_{i,jNext}^{next}+\text{Cycle}_i\chi_{i,j};$$

$d_{i,j}$ are distances from $TL_i$ to next $TL_{next}$ in $Dir_j$ from traffic database.

$\text{Cycle}_i$ are current cycles of $TL_i$ computed at the $1^{st}$ stage.

Step 709: Get boundary constraints for relation between start times and green times obtained from $1^{st}$ stage:

$$G_{i,j}+\delta_{i,j}>t_{i,jNext}-t_{i,j}>G_{i,j}-\delta_{i,j},$$

$$\min\{G_{i,j}-G_{min}, \nu\cdot G_{min}\}\geq\delta_{i,j}\geq 0$$

here $\delta_{i,j}$ are tolerance values for updated $2^{nd}$ stage optimal green times $\nu\in(0,1)$ is an input parameter that defines boundaries for green times according to their optimal values computed at $1^{st}$ stage of optimization as defined by operator.

Step 710: Get multiobjective constraint that use each TL optimal objective values for $2^{nd}$ stage optimization:

$$\sum_{j=1}^{N^{Dir}} G_{i,j} \frac{V_{i,j}^{Real,A}}{2L_{car}C + V_{i,j}^{Real,A}\Delta t} \geq q_i$$

$$i = 1, 2, \ldots, N^{TL}.$$

where $q_i$ is optimal objective value computed in $1^{st}$ optimization stage for $TL_i$;

Objective function is $$q_i = \sum_{j=1}^{N^{dir}} G_j^i K_j^i$$

where $G_j^i$ optimal green time computed in $1^{st}$ stage optimization for direction j and $TL_i$, $K_j^i$ is number of cars that will clear $TL_i$ for direction $Dir_{ij}$ per second.

Step 711: Get Constant cycle constraints (for saturated directions only):

$$t_{i,jLast}+G_{i,jLast}-t_{i,jInit}=C^{Cur},$$

where saturated links are defined by inequality:

$$V_{i,j}^{Real}\leq V_{i,j}^{Allowable}$$

computed in $1^{st}$ optimization stage for $TL_i$.

Step 712: Get recommended speed constraints:

$$V_{i,j}^{next,Real}>V_{i,j}^{next}>0$$

Step 713: Compute the following output variables:

$V_{i,j}^{next}$ is recommended speed on direction $Dir_j$ after $TL_i$ $t_{i,j}$ is start time of next group of green light for $Dir_j$ on $TL_i$;

$t_{i,j}^{next}$ is start time of current group of green light $TL_{next}$ after $TL_i$ in direction that continues $Dir_j$;

$t_{i,jNext}^{next}$ is start time of next group of $TL_{next}$ after $TL_i$;

Step 714: Send optimal output variables to all TL's and client units.

Step 715: Return to 1st Stage Optimization Module.

This model is not linear due to $V_{i,j}^{next}$, $d_{i,j}/V_{i,j}^{next}$; however, if in the objective function we replace $V_{i,j}^{next}$ by $1/V_{i,j}^{next}$ and maximize the objective function instead of minimizing it, the model becomes linear although it includes binary control variables.

Note: the above mathematical problem is mixed linear and can be solved by standard optimization tools such as LINDO or SOLVER of MS Excel.

Individual intersections in oversaturated networks almost invariably create additional traffic loads and vehicle congestion in certain directions. By definition, the optimizations of individual green lights works best with local control systems and these often fail to distribute vehicle loads towards more accessible TLs. As a result, some directions become more saturated, creating additional congestion loads on next traffic lights. In order to avoid accumulation of vehicle loads in specific traffic zones the system uses $2^{nd}$ stage optimization of traffic lights. In this stage it is essential to synchronize green times of a plurality of TL intersections in optimized sequences resulting in green wave preference to less congested directions. The proposed green wave function uses recommended speeds to drivers as means to increase or decrease traveling speeds in certain directions resulting in more green time in these directions while taking into consideration traffic demands on these directions.

In contrast to prior art, the green wave function in this embodiment is highly adaptive and not fixed in specific or preferred direction.

The proposed green wave coordination system will also result in redirecting traffic to less saturated directions as required. This process includes on-line driver-navigation systems and the fastest routes computations. Live traffic information network server updates driver's on-board vehicle navigation units and net-provided traffic guidance systems with recommended speeds on all local links and updates all green light changes in the path of travel.

Dynamic Vehicle Navigation

We consider the problem of constructing a method for finding the fastest route for a vehicle to travel between two points on a map. A map may represent a city, a group of cities, a whole county, etc. The route means a chain of road links usually between road intersections. A road link contains a directed road segment and a turn-off or a go-through segment. The fastest route implies taking into account changing traffic conditions that might include traffic lights, slowdowns, traffic jams, road closures, atmospheric conditions, etc. If we also have additional information, say, traffic light timing, that could be used in finding the fastest route.

Traditionally, optimal route search has been performed by an A* algorithm or its modification. In the present invention, we are using a route guidance method that uses novel time-dependent modifications of an A*-type algorithm in conjunction with a Navigation Travel Time Database. This Travel Time Database includes statistical travel time data, current travel time data, and predicted travel times. Our modifications of an A*-type algorithm also rely on various additional pre-processed data stored in databases, in particular graphs of the region partitioned into subgraphs or cells, intercell distances, intracell distances, lists of reference points, precalculated routes from reference points to selected points on the map and vice versa, etc. Input and output data for this problem are as follows.

Input: Static Data: Region map, coordinate info, distance info, turns info, lane info, additional data.

Dynamic Data: Limit speed info, Lane closure info, Table of statistical travel times, Table of current travel times for road links in the vicinity of the current vehicle position and Tables of travel times produced by various prediction methods.

Output: Optimal route on the map and a corresponding sequence of instructions to the driver.

Figure 8:
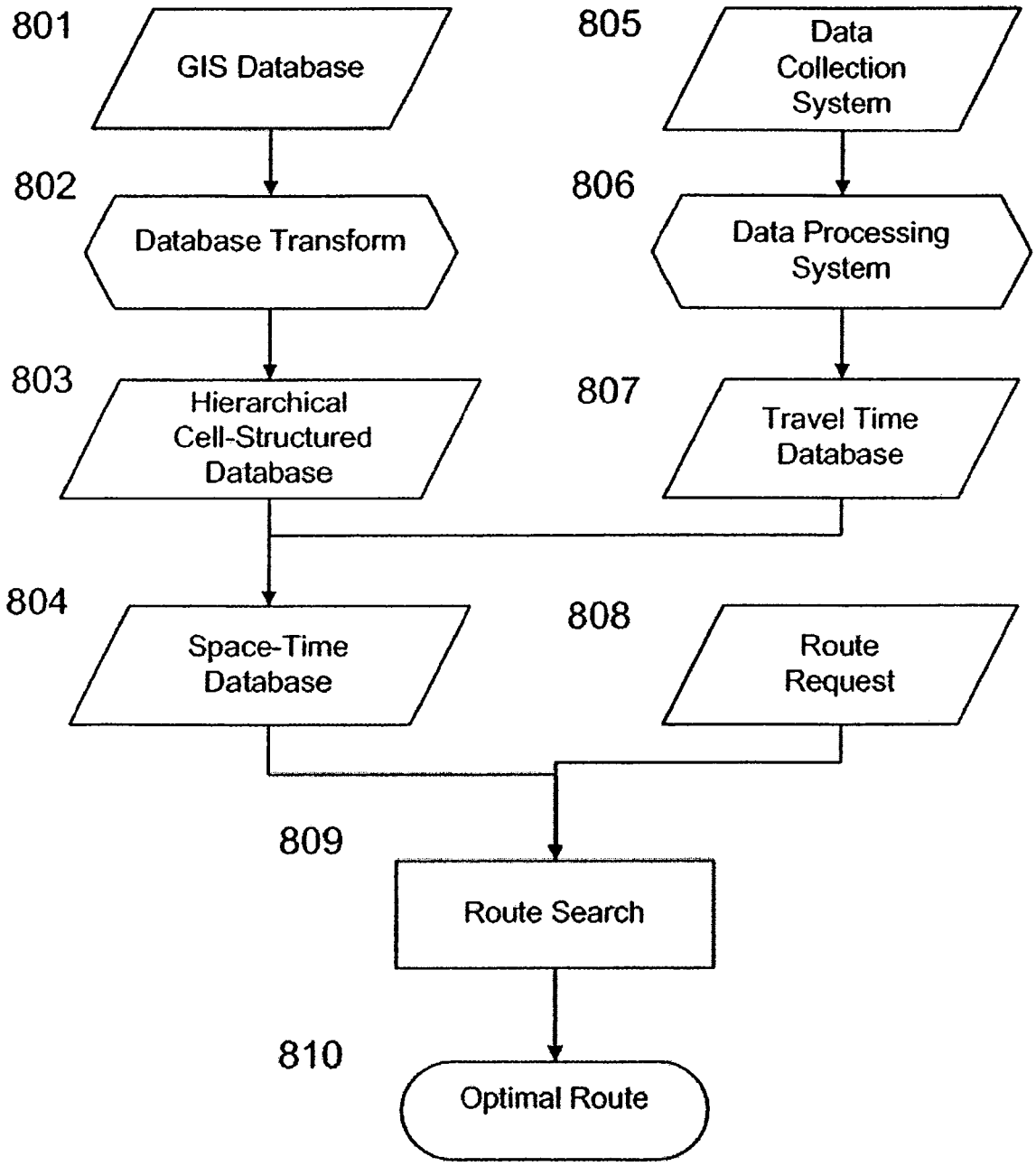
FIG. 8 Navigation Information Flow

FIG. 8: Navigation Information Flow is a flowchart representation of major information structures making up the traffic navigation system, showing (801) the GIS Database used as a basis, (802) Database Transformation into the Hierarchical Cell-Structured Database required in traffic navigation, (803) Hierarchical Cell-Structured Database, (804) Space-Time Database containing both topographical and time-related information, (805) real time Data Collection System providing contemporaneous traffic-related information, (806) Data Processing System that provides the information for the Travel Time Database (807), (808) Route Request originating from a driver, (809) Route Search performed by the Navigation System according to the Route Request, and (810) the Optimal Route found by the Navigation System to be sent to the driver.

The control part of the problem may be divided into 5 parts or 5 algorithms. The algorithms 3 and 4 deal directly with fastest route search and are described in detail below. The algorithms 1, 2 and 5 relate to data conversion problems known in the literature and there is no need to expand and explain them in detail. They are however necessary for constructing a data framework for searches route.

1. Algorithm for converting the Static Data: a given map turns data and lane data into an auxiliary graph G (units 801 to 803 in FIG. 8).
   Input: region map, turn info, lane info, additional data.
   Output: auxiliary graph G: nodes and edges including edge lengths (stored as tables in a database).
2. Algorithm for converting the Dynamic Data: Limit speed info, Lane closure info, Table of statistical travel times, Table of current travel times, etc. into space-time (dynamic) graph TG (units 805 to 807 and 804 in FIG. 8).
   Input: Dynamic Data.
   Output: Space-time (dynamic) graph TG (containing auxiliary graph G with associated travel time data stored as tables in a DB).
3. Time-Dependent Algorithm TA* containing a time-dependent evaluation function $f$ (unit 809 in FIG. 8, described below).
   Input: Space-time graph TG, Start node s, destination node d, evaluation function h, current time T.
   Output: Optimal path from s to d on the space-time graph TG.
4. Time-dependent evaluation function $f$ (unit 809 in FIG. 8, described below)
   Input: Space-time graph TG, Table of statistical travel times: (edge, current time)→travel time, Table of current travel times: (edge, current time)→travel time
   Output: Estimated travel time from the current node i to the destination node d: $h_i(t_i)$.
5. Algorithm for converting an optimal path from s to d on the space-time graph TG into an optimal route on the map or a sequence of instructions to the driver (units 809 to 810 in FIG. 8).
   Input: Optimal path from s to d on the space-time graph TG.
   Output: Shortest route on the map and a sequence of instructions to the driver.

Graph Definitions and Notation

We assume that a dynamic transportation network can be represented by a space-time graph TG which is a directed graph having a set of nodes (road intersections and endpoints) N and a set of edges (arcs) A. $N=\{(n_i,loc_i),i=1,\ldots,m\}$ where $n_i$ is a node, and $loc_i$ is its location. $A=\{(link_{ij},l_{ij},T_{ij}),i,j=1,\ldots,m\}$ Where $link_{ij}$ is a link connecting nodes $n_i$ and $n_j$, $l_{ij}$ is the length (travel distance) of $link_{ij}$, $T_{ij}$ is the time structure that provides a travel time along $link_{ij}$ as a function of leaving time $t_i$ at node $n_i$. We will often denote nodes simply by i, j, s, etc.

For each node i, we have the set of successors $S(i)=\{j:\forall j\in S(i),link(i,j)\in A\}$ and the set of predecessors $P(i)=\{j:\forall j\in P(i),link(j,i)\in A\}$. For specifying a fastest route problem, we have to have a start node s, a destination node d, and a leaving time $t_s$ at start node s.

Navigation Travel Time Database

Figure 9:
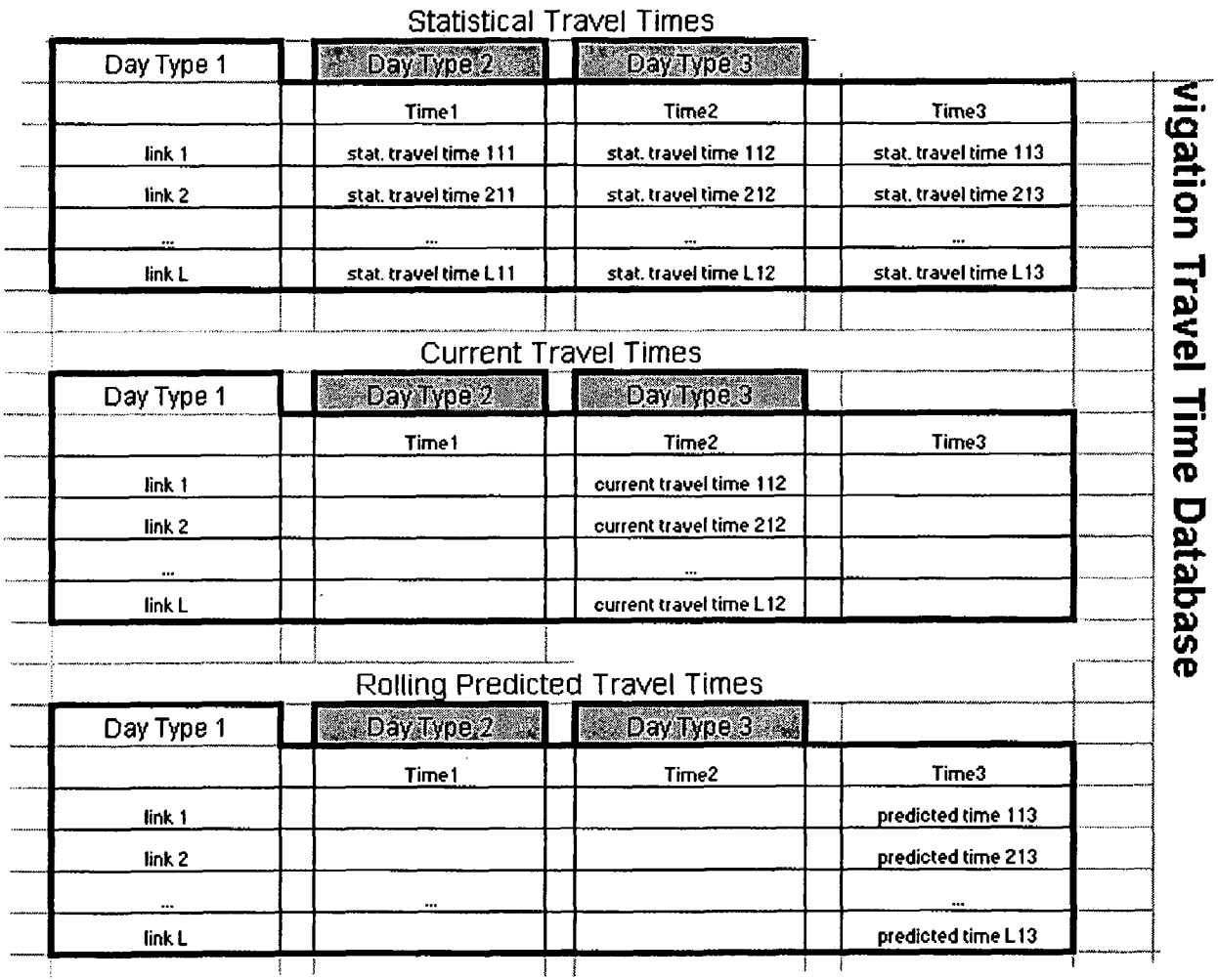
FIG. 9 Navigation Travel Time Database

FIG. 9 shows three parts of the Navigation Travel Time Database: one permanent part and two temporary parts. The first permanent part stores statistical travel times for all road links as functions of day type and time of the day. A day type set is a list of types such that each day of the week belongs to exactly one type. For any two days of the same type, each road link exhibits a common travel time pattern, i.e. for any two days of the same type any road link has the same travel time at the same time of the day. Examples of a day types are: Workday, Holiday, Preholiday, and Postholiday. The second temporary part shows current travel times as they exist at any given time moment. The current travel times are in general vehicle dependent (i.e. they may be different for different vehicles) and they are prone to change at any moment. The third temporary part shows rolling predicted travel times, or short time predicted travel times. Combination or superposition of all those travel times serves as a basis for optimal travel route searches for requesting drivers.

After receiving each route request, the system checks availability and relevance (timeliness) of the second part: those elements of it that are recent and relevant are used for modifying the first part and for producing the third part which will be used in actual computations. To summarize all the sources available for getting estimates of actual travel times for all or some road links we will use a generic functional notation $d_{ij}(t_i)$=arrival_time($link_{ij}$,$t_i$) where $link_{ij}$ is a link of interest, $t_i$ is the time of leaving node i, and $d_{ij}$ is the earliest arrival time to node j when leaving node $n_i$ at time $t_i$ and traveling along a link $link_{ij}$.

Let $g_i(t_s)$ be an estimate of earliest arrival time to node i when leaving the start node s at time $t_s$, and $h_i=h_i(g_i)$ an estimate of the earliest arrival time to the destination node d when leaving the node i at time $g_i$. Also let $f_i=h_i(g_i(t_s))$ be an estimate of the earliest arrival time to the destination node d when leaving the start node s at time $t_s$, then going to node i, leaving the node i at time $g_i(t_s)$ and from there going to node d.

Let OPEN be the set of nodes opened by an A*-type algorithm at any given moment, and CLOSED is the set of nodes closed at any given moment. Note that $g_i=g_i(t_s)$, and $f_i=h_i(g_i(t_s))$ have already been computed for all nodes on OPEN and CLOSED. Each node i is a structure $(t_s,g_i,f_i,BP_i)$ where $g_i=g_i(t_s)$ and $f_i=h_i(g_i(t_s))$ are as defined above, and $BP_i$ is a pointer from node i back to a predecessor of i. The lists (priority queues) OPEN and CLOSED are ordered increasing in $f_i$.

A solution for a problem is a chain of nodes $(n_i,t_i,FP_i)$ for i=1, . . . , q where $n_i$=s, $n_q$=d, and $FP_{i-1}=n_i$ for i≥2, a list of travel times: $g_1(t_s)=g_s(t_s)=t_s$, $g_2(t_s)$, . . . , $g_q(t_s)=g_d(t_s)$, and the total travel time is $g_d(t_s)$.

Algorithm

Input: Graph TG, Start node s, Destination node d, Arrival time function g, Estimation function h.

Output: Solution chain $\{n_i\}$ with $n_i$=s and $n_q$=d, List of travel times.

Start of Algorithm

```
while OPEN ≠ Ø , do:
   select i ∈ OPEN that minimizes f_j // first node on queue OPEN
   if i == d // solution found
   extract_solution(i)
   goto L // Problem solved
   end (if i == d )
   delete i from OPEN
   put i on CLOSED
   Expand(i)
end (while OPEN ≠ Ø )
if OPEN == Ø send warning 'No solution found'
L: End
Function extract_solution(i)
Beginning from node d , reverse node back pointers to obtain forward
pointers for a solution chain {n_i} with n_1 = s and n_q = d .
Construct list of travel times:
g_1(t_s) = g_s(t_s) = t_s,g_2(t_s), g_q(t_s) = g_d(t_s). The total travel time is g_d(t_s).
Function Expand(i)
Generate list S(i)
for all j ∈ S(i), do:
   Compute g_c = d_ij(g_i)
   Compute f_c = h_j(g_c) = h_j(d_ij(g_i))
   If f_c < f_j, do:
   g_j = g_c
   f_j = f_c
   set pointer back from j to i
   if j ∈ OPEN
   goto L1
   elseif j ∈ CLOSED
   delete j from CLOSED
   end (if j ∈ OPEN )
   put j on OPEN
   end (If f_c < f_j )
   L1:
end (for all j ∈ S(i) )
```

Estimating Functions

Let $t_a$ denote an earliest arrival time to the destination node d leaving i at time $g_i$. To keep Algorithm TA* admissible, function h has to be a lower bound estimate of that earliest arrival time $t_a$. If $\Delta t_a$ is the shortest time interval needed to arrive from node i to destination d leaving i at time $g_1$, then $t_a=g_i+\Delta t_a$. Provided we have a lower bound estimator on $\Delta t_a$, say, $\Delta\check{t}_a$, we can use as $h_i$ the quantity $h_i=g_i+\Delta\check{t}_a$.

Estimators for $\Delta t_a$

Let r be the length of a possible travel route from node i to destination node d, and v a corresponding (hypothetical) travel speed. Denoting a lower bound estimator of r by $\check{r}$, and an upper bound estimator of v by $\hat{v}$, we can write a lower bound estimator $\Delta\check{t}_a$ as $\Delta\check{t}_a=\check{r}/\hat{v}$. To proceed, we need a means to obtain a pair of estimators $\check{r}$ and $\hat{v}$.

Estimators for Travel Route r

1. A naive estimator $\check{r}$ is an Euclidean distance between node i and destination d.
2. A better estimator $\check{r}$ could be obtained based on some preprocessing performed on the TG graph.

For our purposes, preprocessing consists in precomputing various quantities related to TG graph and storing them in a database in such a way that they could be retrieved by standard queries at any moment.

Partitioned Graphs

A graph can be partitioned into a set of subgraphs also called cells or fragments. Cells are usually made of highly connected regions of the road network. Each node of the graph belongs to exactly one cell. Cell is a subgraph such that an edge connecting two nodes is in a cell if a link connecting the two nodes is in the original graph. A node is a boundary node if it belongs to more than one cell. All other nodes are internal nodes. A cell boundary is the set of all boundary nodes of the cell. The edges that connect nodes in different cells are called boundary edges.

Figure 10:
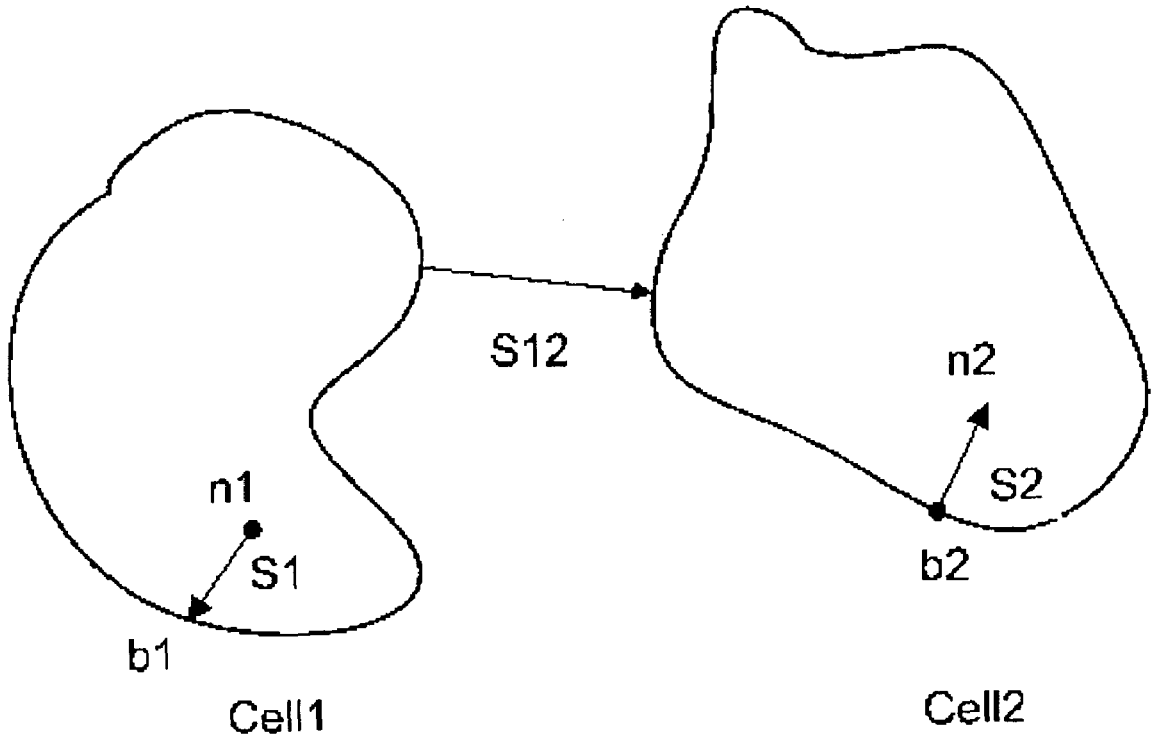
FIG. 10 Map Cells and Cell Distances

Assume that the following quantities have been pre-computed and stored (FIG. 10):

1. Minimum travel path distance from any node to the boundary of that node's cell, where minimum distance to the boundary means minimum distance among distances to all boundary nodes.
2. Minimum travel path distance between boundaries of any two cells.

If two nodes $n_1$ and $n_2$ are in different cells $C_1$ and $C_2$, then a lower estimate of travel route between them may be calculated as $L_{12}=S_1+S_{12}+S_2$ where $S_1$ is the minimum travel path distance from $n_1$ to the boundary of $C_1$, $S_{12}$ is the minimum travel path distance between boundaries of the cells $C_1$ and $C_2$, $S_2$ is the minimum travel path distance from $n_2$ to the boundary of $C_2$. If the nodes $n_1$ and $n_2$ are in a common cell, then either a precalculated distance may be used if it has been stored, or an Euclidean distance as indicated above.

Estimators for Travel Speed v

1. A naive upper bound estimator $\hat{v}$ is a maximum speed in the whole database.
2. A better estimator $\hat{v}$ could be obtained by narrowing the range of potential speeds over which maximum is taken.

By speed we mean average speed at a given link; it may not correspond to an actual vehicle speed but is useful in computations. Not that under the selected setup, the database stores travel times rather than average speeds. For finding a maximum speed in the whole database, all travel distances are divided by their stores travel times.

Maximum speed estimators may be obtained as follows.

2A. Calculate maximum speed over a DB subset defined by a predicate like Day Type, or city speed limit.

2B. Calculate maximum speed over a DB subset defined by a time window $[t_i,t_i+\Delta t]$ where $t_i$ is the current time and $\Delta t$ has to be determined. The period $\Delta t$ should be such that $(t_i+\Delta t)$ is a guaranteed arrival time to the destination d. In other words, we have to find an upper bound $\Delta\hat{t}$ on $\Delta t$.

One way of obtaining an upper bound $\Delta\hat{t}$ is as follows. Suppose, we know a travel route from the node i to the destination d. Then departing from the node i at time $t_i$, we can easily compute the arrival time t* to destination d by traveling along that route, and take $(t^*-t_i)$ as an upper bound $\Delta\hat{t}$. To be able to use a travel route from the node i to the destination d, we need some precalculated quantities.

Figure 11:
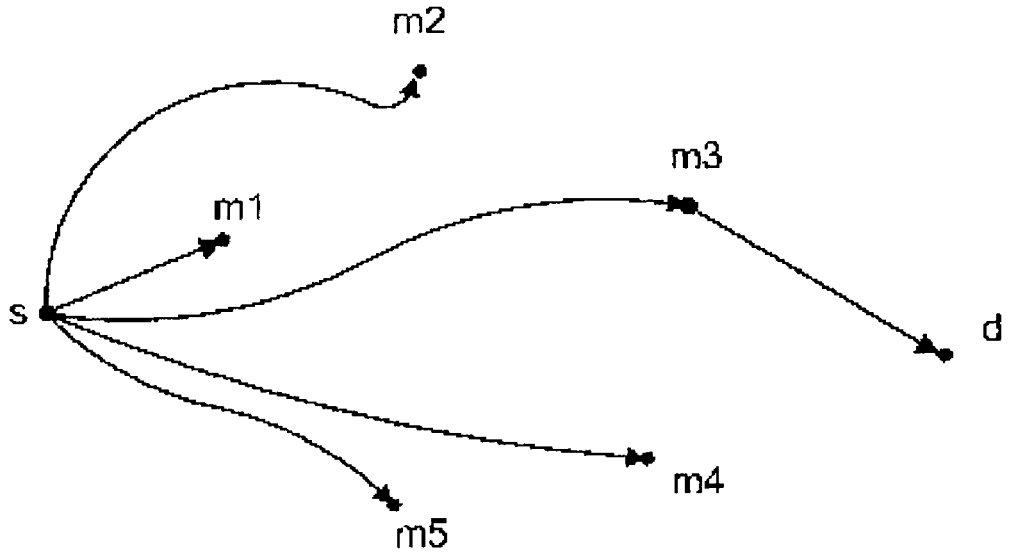
FIG. 11 Reference Points and Pre-calculated Distances

Assume that the following quantities have been precalculated and stored (FIG. 11):

1. A set of geographical points (nodes) on the map.
2. Shortest travel routes from any node to all selected points, and shortest travel routes from all selected points to all nodes.

Let $M=\{m_1, \ldots, m_K\}$ be those points. Now we can obtain a travel route from the start s to the destination d by taking a shortest travel route among the K stored routes from the start s to $m_i$ and then from $m_i$ to d.

Computation of Estimator h

1. Compute $\check{r}$.
2. Obtain a route from i to d. When departing i at time $t_i$ the corresponding travel time will be used as $\Delta\hat{t}$.
3. Compute maximum speed $\hat{v}$ in DB over the travel time window $[t_i, t_i+\Delta\hat{t}]$.
4. Compute travel time estimate $\Delta\check{t}_a=\check{r}/\hat{v}$.
5. Compute $h_i=t_i+\Delta\check{t}_a$.

Computation of Function $h(i,t_i)$

Input: Distances between all nodes and boundaries of their cells, shortest travel routes from any node to all selected points, and shortest travel routes from all selected points to all nodes.

Output: Value of $h(i,t_i)$

```
Start of Function
Compute r̆
if (nodes i and d are in a common cell)
   set r = dist(i,d)
else
   S1 = dist(i,boundary(Ci))
   S12 = dist(boundary(Ci),boundary(Cd))
   S2 = dist(d,boundary(Cd))
   r = S1 + S12 + S2
end (if (nodes ...))
Compute Δt̂
for k = 1,...,K calculate dk = dist(i,mk) + dist(mk,d)
set l(D) = min_k(dk) where D is the shortest route, and l is its length.
For route D , compute an arrival time ta to d starting at i at time ti .
Compute Δt̂ = ta − ti .
Compute maximum speed v̂ in BD over the travel time window
[ti,ti + Δt̂] .
v̂ = max v over the time window [ti,ti + Δt̂] .
Compute Δt̆a: Δt̆a = r̆/v̂.
Compute h(i,ti) = ti + Δt̆a .
End of Function
```

Navigation Summary and Conclusions

As noted in prior art, the problem of providing optimal routes to drivers in real time using concurrent road network conditions is a difficult problem. It involves among other things processing and combining data from various sources, managing huge databases, maintaining and updating dynamic models of saturated networks, making short time predictions of traffic times, and optimal paths calculations in large graphs. Dynamic traffic navigation system in the present invention provides fastest routes by applying novel dynamic time-dependent versions of shortest path searching techniques for the system database. These include statistical travel time tables, current travel times and short time predicted travel times. To make searches fast and effective, the present invention relies on preprocessed information prepared and stored routinely in central network databases, and in particular, graphs of the regions partitioned into subgraphs or cells (mathematical presentation of regional road networks), intercell distances, intracell distances, lists of reference points, and precalculated routes from reference points to selected points on the map and vice versa.

Short Travel Time Prediction Module

Main objective of short travel time prediction module is to provide live and predictive traffic guidance for short to intermediate trip durations in congested traffic. It is designed to provide optimal departure time, total travel length and duration times in preplanning stages and on route optimal guidance to plurality of drivers and their navigation units throughout their entire trip.

In the preferred embodiment the on-line navigation server sends dynamic traffic data packets to large number of vehicle navigation units simultaneously via multiple broadcasts. Clients obtain dynamic recommended travel time tables and green times in their vehicle units for live fastest route searches and live traffic guidance.

Accurate predictions of travel times in saturated networks are in most cases very complex, involving many random traffic events. In practice, statistic or historic travel time tables are often inadequate in predicting dynamic nature of traffic loads and their influence on travel times in the network. Time-dependent predictions for specific destinations must therefore include estimation models that will take into account the changing conditions and adjust current, predicted and historical travel times accordingly. The main purpose of short to intermediate travel time predictive model is to develop a bridge between current traffic data from the traffic control server and historical statistical data used in on vehicle navigation units.

Figure 12:
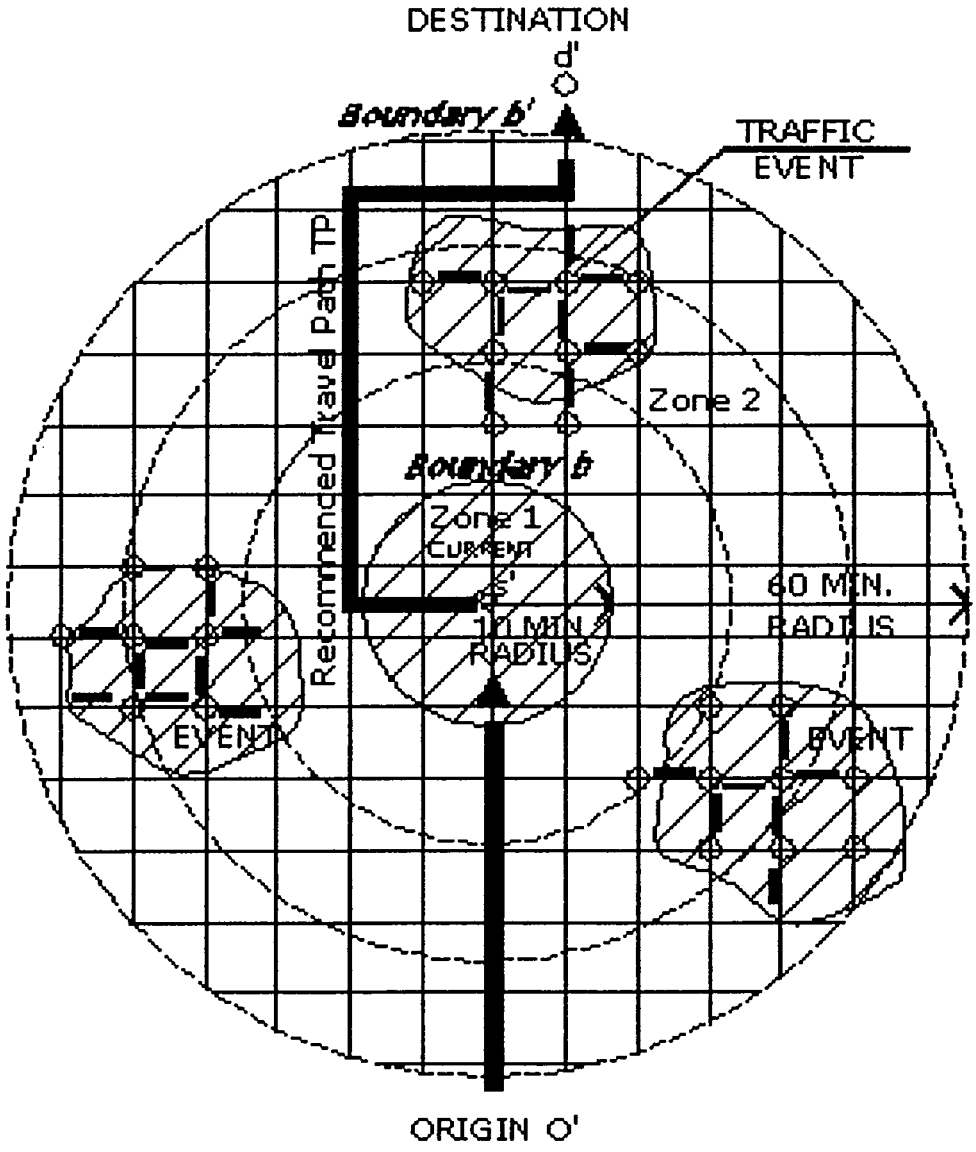
FIG. 12 Short Travel Time Prediction Function

FIG. 12 shows predictive model diagram for short to intermediate travel time computations. Real time travel data from central traffic control server are accurate in the immediate radius of say 5 to 10 minutes of travel time. The system creates current travel time tables for all links for the initial 10 minute travel boundary, designated as Zone 1. The current travel time tables are updated every 2-5 minutes from traffic control center. Short term and intermediate estimated travel time predicted tables are created for all links, for 10-60 minute perimeter range designated as Zone 2. Historical or statistical travel times will be used for all travel links beyond 60 minute perimeter. In the FIG. 12 example the current vehicle traveling from Origin O' is presently located in Zone 1 at point s (x, y, z) on-route to destination D'. Driver route request is for an intermediate trip of say, 80-100 minutes, where the fastest route algorithm uses all three levels of travel tables based on origin and destination: current travel time tables, short term predicted time tables and historical or statistical time tables to obtain the estimated fastest route dynamically.

Short Term Prediction Function with Fastest Route Search

This function creates a dynamic rolling saturation register log for each TL link based on statistical time of day. Short term prediction tables have a limit of 60 minutes rolling horizon with a continuous updates every 5 minutes. The logs are stored on the central database and can be used also in updating the statistical daily data.

Figure 13:
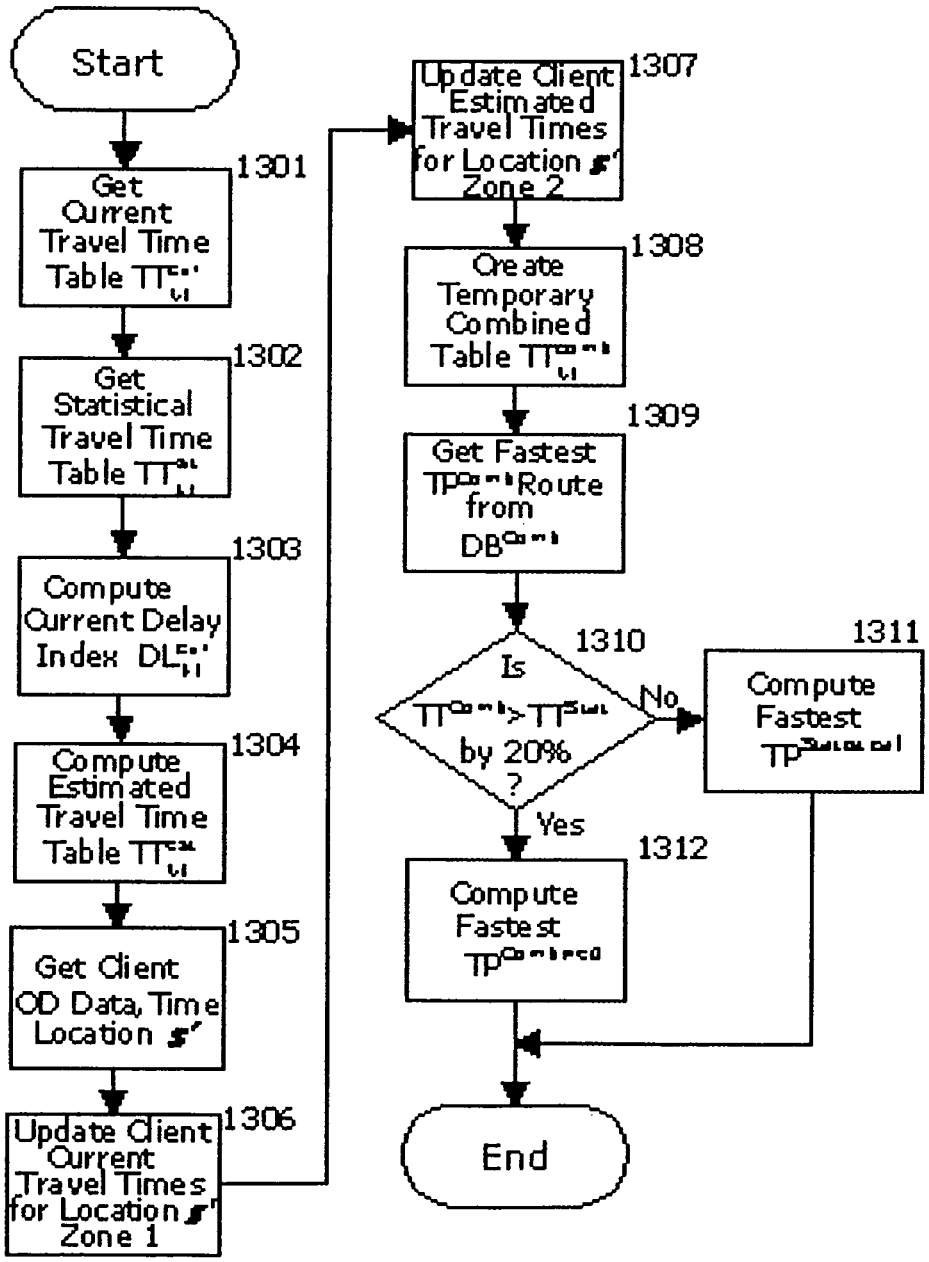
FIG. 13 Short Term Prediction with a Function Fastest Route Search

FIG. 13 shows short term prediction function flowchart in central traffic navigation center.

Step 1301: Get current travel times $TT_{i,j}^{Cur}$ for each link from current travel time tables.

Step 1302: Get statistical travel times $TT_{i,j}^{St}$ from time-dependent statistical table obtained for the same current period and future 60 minutes rolling horizon with step increments of 5 minutes.

Step 1303: Get current congestion delay index: $DL_{i,j}=TT_{i,j}^{Cur}/TT_{i,j}^{St}$ for each TL link. This ratio expresses current degree of congestion for each TL travel link relating to statistical data for the same period. The current delay ratio is used in estimated predicted delay within the 60 minute horizon in the next step. The 60 minute horizon limit can be adjusted by operator depending on current traffic congestion.

Step 1304: Get estimated travel time table for link $TT_{i,j}^{Est}$ based on current and predicted delay index $DL_{i,j}$ on that link. The system obtains current travel time on each TL intersection based on current time of day and using exponential extrapolation formula:

$$TT_{ij}^{Est}=\min(TT_{ij}^{St}DL_{ij}^{(DL_{ij}/\Delta T)},TT_{ij}^{Cur})$$

where ΔT is a typical 5 minute time interval of 15, 20, 25, . . . 60 minutes. i.e. if $TT_{i,j}^{Cur}$=10:00:00 then ΔT=10:15:00, 10:20:00, 10:25:00 etc. It should be noted that in the present estimating function the current c delay $DL_{i,j}$ influence is significantly reduced as the ΔT interval increases. Estimated travel time tables are updated and stored on temporary system database for each link. These tables together with current travel times will form a major part of dynamic traffic packs that are dynamically broadcasted to individual vehicle navigation units.

Next steps show the method in central server of simultaneous broadcasting current and estimated travel time tables to plurality of vehicle units on-line. In order to save storage space, the server coordinates the table updates according to x, y, z location of requesting vehicle. In FIG. 12 the navigation server first processes start node s of vehicle located in Zone 1 and destination nodes d located in Zone 2 according to the features of the present embodiment. The first circle designates all links inside Zone 1 and its boundary B using current recommended travel times $TT_{i,j}^{Cur}$. In the second concentric circle i.e. in the Zone 2 the system uses estimated times $TT_{i,j}^{Ext}$ on all links.

Step 1305: Get client GPS location if available and current start node s and destination node d, request ID, time of request of proposed trip etc. and stores data in the navigation DB.

Step 1306: Generate 10 minute travel time radius from current travel time data $TT_{i,j}^{Cur}$ from GIS map and coordinates of client's start node s and updates all current travel times on the vehicle $DB^{Cur}$ in Zone 1. The current 10 min. radius boundary is updated at each subsequent route requests creating dynamic boundary rolling effect along the travel path.

Step 1307: Generate 60 minute travel time radius from the estimated travel times $TT_{i,j}^{Ext}$ and updates the on-vehicle unit databases with the estimated travel times $TT_{i,j}^{est}$ in Zone 2 similar to current time updates method. In the present embodiment the central server updates all client navigation units in one to many broadcasts so that current and estimated travel tables can be grouped in packs according to vehicle GPS locations or current position requests.

Step 1308: Perform fastest route search in the on vehicle unit after it receives the live traffic update packs. The unit processor combines all three tables and creates a temporary combined database $DB^{Comb}$ which is updated dynamically at, say, 5 min. interval.

Step 1309: Compute the fastest route search using $DB^{Comb}$ time-dependent function above.

Step 1310: Check for fastest path based on $DB^{Comb}$ for OD requested by client and computes the fastest recommended path $TP^{Combined}$ and compares the computed time with that of $TP^{Stats}$ travel time. If the total difference of two travel path values does not exceed a preset threshold value say, 20%

Step 1311: Display $TP^{Stats}$ travel time path in fastest route computations on the on-board navigation unit.

Step 1312: Compute fastest travel path $TP^{Comb}$ based on the combined database comprising current, combined and statistical data as described above on client display in the vehicle navigation unit.

The vehicle navigation units dynamically recalculate current travel path $TP^{Cur}$ and modify fastest travel routes by processing additional traffic guidance data from on-line navigation system data updates. Since all recommended speeds and directional traffic movements are monitored and updated on all links, the central server sends out live broadcasts of current traffic data to plurality of vehicle units in real time, and thus re-routing plurality of vehicles away from congested intersections.

Other methods of live traffic navigation updates are also available: local TL green times and recommended speeds are broadcasted to all passing vehicles within the local transmission range equipped with suitable antenna receivers and on-board navigation units. Current location information can also be updated at any number of on-line connected roadside displays along the travel path. Drivers stay updated by following traffic monitors advisory messages and recommended travel speeds to clear approaching traffic lights, green wave recommendations, and alternate routes, changing traffic conditions, traffic jams, road closures and atmospheric conditions reports.

Alternate Embodiment

As explained above, the overall performance of optimized traffic control in saturated networks depends on live traffic data collection and traffic congestion processing on plurality of saturated intersections in real time. The proposed patent presents basic methods of individual traffic light camera processing and image analysis for local and central traffic network optimization and green way coordination.

In this embodiment we use high resolution airborne thermal imaging cameras and satellite surveillance radar images such as synthetic aperture radar (SAR) and the inverse synthetic aperture radar (ISAR). The remote sensors are used for larger scale vehicle volume and congestion analysis. Sensor radar images from orbiting satellites provide traffic images for large urban areas and are more suitable for live network traffic monitoring. The streaming data from single, fixed radar source such ISAR provides traffic data images for large urban zones in extent of 10-30 km. The SAR or ISAR imaging while requiring specific software for data interpretation does not differ substantially from pixel images provided by other sources and are therefore suitable for brightness analysis in much the same fashion as presented above. In the infrared thermal imaging the reverse polarity (black=hot) images makes the brightness analysis even more straightforward. The plurality of intersections are designated and processed by the system according to traffic templates with operator-set parameters and are combined together with GIS road layer system and database.

The operator further designates approach lane and relevant exit regions on each intersection as described before.

The relevant series of SAR images are superimposed over GIS template coordinates and specific mathematical compensation is applied for vehicle/satellite movement corrections. Resulting vehicle congestion on plurality of traffic lights is mapped and computed in the central server in nearly real time.

According to this invention it is not necessary to generate detailed identification of individual vehicles as in prior art. User applies designated intersection template over radar or infrared images and much of the non relevant information is automatically filtered out. Computing congestion on specific approach and exit regions with short-time high and low peek-traffic calibrations significantly reduces processing time generally required for radar image and object interpretation.

Comparing several radar images from one location and using local traffic templates the processor computes relevant absolute pixel brightness variance of the images and estimates relevant vehicle parameters such as vehicle loading and general direction of vehicle travel.

Stationary radar configurations such as ISAR are better adapted for moving object detection such as road vehicles and are also suitable for showing number of vehicle travel-directions simultaneously.

The main advantage of remote traffic monitoring and road sensing systems is in that the ISAR, airborne thermal infrared cameras and to a certain extent SAR images provide live traffic data for wide urban areas simultaneously and are not affected by local weather and ground conditions. These systems also allow continuous 24-hour traffic coverage allowing full monitoring of night traffic as well.

Another advantage of the ISAR/SAR image analysis is that it can be executed in the central traffic processor in near real time. The proposed method of satellite image processing therefore significantly reduces overall costs related to traffic data collection and gathering, reliably replacing traditional data collection means from plurality of road sensors and other video or radar traffic surveillance systems.

What is claimed:

1. A method for real time adaptive traffic light control of a plurality of intersection through evaluating traffic flow through the plurality of intersections, said method comprising the steps of:

a) evaluating traffic flow through the plurality of intersections wherein a current vehicle loading and vehicle congestion on the plurality of intersection is generated by measuring from the air or from space an image brightness for each of the plurality of intersections from one or more of a space borne high resolution camera, a thermal imaging camera or air satellite surveillance radar including synthetic aperture radar (SAR); and b) determining a timing of green lights for said plurality of intersections, a. wherein in step a) the current vehicle loading is generated by using brightness heterogeneity analysis of approaching lane regions and exit lane regions of the plurality of intersections, and the determining of the timing of the green lights for said plurality of intersections is based on the current vehicle loading, and b. wherein the brightness heterogeneity analysis is based on pixel brightness variance of image pixel strings inside designated boundary polygon regions that represent the approaching lane regions and the exit lane regions.

2. The method according to claim 1, wherein, for each of the plurality of intersections, a captured image includes bitmap images collected over a short calibration period and estimated vehicle loading is generated using a pixel brightness value on specified traffic lane-regions corresponding to approaching lane regions and exiting lane regions in collected bitmap images.

3. The method according to claim 1, wherein estimated vehicle loading is computed according to a quantity of pixel strings from a captured image in horizontal and vertical directions of a region where a difference of an initial and an ending pixel brightness exceeds a pre-set tolerance brightness value.

4. A method for real time adaptive traffic light control according to claim 1, wherein the vehicle load is generated independently of determining the actual location of each vehicle.

5. A method for real time adaptive traffic light control according to claim 1, wherein step b) includes the step of determining timing of green lights relative to each other for the plurality of intersection.

6. A method for real time adaptive traffic light control according to claim 4, wherein step b) includes the step of determining timing of green lights relative to each other for the plurality of intersection.

* * * * *